US010769719B1

(12) United States Patent
Windsor et al.

(10) Patent No.: US 10,769,719 B1
(45) Date of Patent: Sep. 8, 2020

(54) ELECTRONIC BIDDING SERVICE USING AN ITEM AUTHORITY

(71) Applicant: Amazon Technologies, Inc., Seattle, WA (US)

(72) Inventors: Scott Kerns Windsor, Seattle, WA (US); Matthew K. Green, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 349 days.

(21) Appl. No.: 15/673,132

(22) Filed: Aug. 9, 2017

Related U.S. Application Data

(62) Division of application No. 11/277,558, filed on Mar. 27, 2006, now Pat. No. 9,754,316.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
See application file for complete search history.

(56) References Cited

U.S. PATENT DOCUMENTS 5,551,021 A 8/1996 Harada et al.
5,592,375 A 1/1997 Salmon et al.
5,694,551 A 12/1997 Doyle et al.
5,758,328 A 5/1998 Giovannoli
5,799,284 A 8/1998 Bourquin
5,835,896 A 11/1998 Fisher et al.
5,870,717 A 2/1999 Wiecha
5,895,454 A 4/1999 Harrington
5,970,475 A 10/1999 Barnes et al.
6,023,683 A 2/2000 Johnson et al.
(Continued)

FOREIGN PATENT DOCUMENTS

WO WO0062223 10/2000
WO WO0078557 12/2000
(Continued)

OTHER PUBLICATIONS

Business Wire "Half.com Unveiled, Transforms Person-to-Person E-commerce; New online marketplace launches with more than one million books, CDs, movies and video games listed," dated Jan. 19, 2000.

(Continued)

*Primary Examiner* — Naeem U Haq
(74) *Attorney, Agent, or Firm* — Lee & Hayes, P.C.

(57) ABSTRACT

An electronic bidding service is described which substantially automatically acquires items for buyers in response to bidding information entered by the buyers. To function in this manner, the electronic bidding service makes use of an item authority. The item authority links items specified in different offers to master reference information associated with the items, thereby allowing the electronic bidding service to identify groups of offers which are selling the same or related item. In one case, a buyer can instruct the electronic bidding service to obtain a desired item from a specific offer. If this bid is unsuccessful, the electronic bidding service can extend the bidding procedure to one or more other offers that feature the same or related item. This extension is based on the master reference information.

20 Claims, 10 Drawing Sheets

(56) References Cited

U.S. PATENT DOCUMENTS

| | | | |
|---|---|---|---|
| 6,058,417 | A | 5/2000 | Hess et al. |
| 6,243,691 | B1 | 6/2001 | Fisher et al. |
| 6,266,651 | B1 | 7/2001 | Woolston |
| 6,282,548 | B1 | 8/2001 | Burner et al. |
| 6,298,330 | B1 | 10/2001 | Gardenswartz et al. |
| 6,338,047 | B1 | 1/2002 | Wallman |
| 6,405,175 | B1 | 6/2002 | Ng |
| 6,449,599 | B1 | 9/2002 | Payne et al. |
| 6,466,918 | B1 | 10/2002 | Spiegel et al. |
| 6,473,738 | B1 | 10/2002 | Garrett |
| 6,489,968 | B1 | 12/2002 | Ortega et al. |
| 6,658,390 | B1 | 12/2003 | Walker et al. |
| 6,671,674 | B1 | 12/2003 | Anderson et al. |
| 6,714,933 | B2 | 3/2004 | Musgrove et al. |
| 6,754,636 | B1 | 6/2004 | Walker et al. |
| 6,922,676 | B2 | 7/2005 | Alnwick |
| 7,209,895 | B2 | 4/2007 | Kundtz et al. |
| 7,505,929 | B2 | 3/2009 | Angert et al. |
| 7,702,545 | B1 | 4/2010 | Compton et al. |
| 7,729,977 | B2 | 6/2010 | Xiao et al. |
| 7,809,607 | B2 | 10/2010 | Gantman et al. |
| 2001/0054021 | A1 | 12/2001 | Kawakura et al. |
| 2002/0032626 | A1 | 3/2002 | DeWolf et al. |
| 2002/0107761 | A1 | 8/2002 | Kark et al. |
| 2002/0116305 | A1 | 8/2002 | Abhyanker |
| 2003/0040953 | A1 | 2/2003 | Kasler et al. |
| 2003/0083961 | A1 | 5/2003 | Bezos et al. |
| 2003/0154398 | A1 | 8/2003 | Eaton et al. |
| 2003/0200156 | A1 | 10/2003 | Roseman et al. |
| 2003/0204447 | A1 | 10/2003 | Dalzell et al. |
| 2003/0204449 | A1 | 10/2003 | Kotas et al. |
| 2004/0015391 | A1 | 1/2004 | Dupreez et al. |
| 2004/0230503 | A1 | 11/2004 | Lucas |
| 2005/0010494 | A1 | 1/2005 | Mourad et al. |
| 2006/0224502 | A1 | 10/2006 | McGowan |
| 2006/0242053 | A1 | 10/2006 | Avital |
| 2008/0256451 | A1 | 10/2008 | Chu et al. |

FOREIGN PATENT DOCUMENTS

| | | |
|---|---|---|
| WO | WO0155936 | 8/2001 |
| WO | WO0182107 | 11/2001 |

OTHER PUBLICATIONS

Homepage for www.MyCar.com, available at <<www.MyCar.com>>, accessed on Jul. 14, 2006, 1 page.

Johnson, "Does it pay to be a first mover in e.commerce? The case of Amazon.com," Management Decision; London, 2000, nine pages.

Office action for U.S. Appl. No. 11/277,558, dated Feb. 24, 2014, Windsor, et al., "Electronic Bidding Service Using an Item Authority", 10 pages.

Office Action for U.S. Appl. No. 11/277,558, dated Nov. 9, 2016, Windsor et al., "Electronic Bidding Service Using an Item Authority", 10 pages.

Office Action for U.S. Appl. No. 11/277,558, dated Dec. 17, 2014, Scott K. Windsor, "Electronic Bidding Service Using an Item Authority", 8 pages.

Final Office Action for U.S. Appl. No. 11/277,558 dated Jun. 23, 2015, Scott K. Windsor, "Electronic Bidding Service Using an Item Authority", 10 pages.

Office action for U.S. Appl. No. 11/277,558, dated Aug. 2, 2013, Windsor et al., "Electronic Bidding Service Using Item Authority ", 9 pages.

Plotnikoff, "Navigation tools help the Web traveler," San Jose Mercury News Center, posted Feb. 5, 2000.

Rivera, "Second Chance // Bell Lady Makes Small Business Venture into Antiques," Tulsa World; Tulsa Oklahoma, Sep. 17, 1997, two pages.

Roscheisen, et al., "Beyond browsing: shared comments, SOAPs, trails and on-line communities," Computer Networks and ISDN Systems, pp. 739-749 (1995).

Rothkopf, et al., "Modeling Competitive Bidding: A Critical Essay", The Institute of Management Sciences, Mar. 1994, vol. 40, No. 3, pp. 364-384.

Slatella, "Online Shopper; Virtual Garage Sales, With No Haggling," The New York Times, dated Apr. 6, 2000.

Thomas, "Attention, online shoppers," New WOman; New York, Sep. 1999, four pages.

Woodall, "Launch Week A 'Whirlwind' for Half.com," The Philadelphia Inquirer, dated Jan. 24, 2000.

ELECTRONIC BIDDING SERVICE USING AN ITEM AUTHORITY

RELATED APPLICATIONS

This application claims priority to and is a Divisional of U.S. patent application Ser. No. 11/277,558, filed on Mar. 27, 2006, the entire contents of which are incorporated herein by reference.

TECHNICAL FIELD

This subject matter generally relates to strategies for performing transactions. In a more particular exemplary implementation, this subject matter relates to strategies for buying and selling items using an electronic bidding service.

BACKGROUND

The Internet has fostered the growth of many new techniques for transacting business. One technique that has enjoyed success is electronic bidding. In a typical electronic bidding scenario, a buyer submits a search term to a bidding service. The search term describes an item that the user wishes to purchase. Assume, for example, that the buyer is interested in purchasing a CD by a hypothetical artist, John Smith. The buyer might therefore enter the search term "John Smith". The electronic bidding service responds by presenting a list of one or more offers for items that match the search term. For instance, the electronic bidding service may present a list of recordings being offered by different sellers that feature the artist John Smith. Each of these offers includes a textual and/or pictorial description of the item being offered, created by the respective sellers of the items.

In typical practice, the buyer will examine the list of matching offers to determine whether one of more of the offers match the buyer's needs. The buyer can then optionally place a bid on a selected offer. If the bid proves successful (vis-à-vis other potential bids), the electronic bidding service allows the buyer to consummate the transaction by purchasing the selected item. At this stage, for instance, the electronic bidding service may inform the buyer of the total costs involved in the transaction, which may involve shipping costs, taxes, and other potential costs. The buyer may then specify a preferred mode of payment, a preferred mode of shipment, and so forth. On the other hand, if the bid is not successful, the buyer may opt to repeat the above-described process by again examining the list of candidate offers, selecting another offer which meets the buyer's needs, and then placing a bid on that other offer.

While the above-described model has proven viable, it is not without shortcomings. As can be appreciated from the above description, a typical electronic bidding service requires the buyer to make several selections at different junctures in the bidding process. A buyer may regard this aspect of the electronic bidding service as cumbersome. This potential drawback is exacerbated in those cases in which the buyer's bid fails, requiring the buyer to essentially start over from the beginning of the bidding process.

One aspect of the bidding process that a buyer may find particularly onerous is the identification of an offer that matches the buyer's needs. In actual practice, multiple sellers might be offering the same item via the electronic bidding service, such as the same CD by the artist John Smith. However, conventional electronic bidding services do not include a mechanism for alerting the buyer to the fact that two or more offers may pertain to the same item. This creates potential confusion for the buyer, as different sellers will create different textual and/or pictorial descriptions of the items, and the buyer may have difficulty in determining whether the different descriptions actually pertain to the same item. Thus, if a bid is unsuccessful for an offer associated with a particular item, the buyer may have difficulty identifying other offers for the same item.

For at least the above-identified reasons, there is a need for more satisfactory electronic bidding strategies.

SUMMARY

A bidding service is described that potentially reduces the amount of interaction with the buyer. In this process, the buyer enters bidding information that specifies salient information regarding the kind of acquisition that the user wishes to make. Based on the bidding information, the bidding service automatically acquires the desired item, substantially without further interaction from the buyer.

In order to function as described above, the bidding service can associate each item that it offers with master reference information. Through this provision, the bidding service can automatically identify multiple offers that describe the same or related item. This proves potentially useful in different circumstances; for instance, if a bid is not successful for a first-identified offer, the electronic bidding service can use the master reference information to automatically identify another offer that features the same or related item, and apply a bid for that other offer. In other words, the user does not need to manually analyze a list of candidate offers to determine whether one or more offers in that list pertain to the same or related item.

According to another exemplary feature, at the start of the bidding process, the electronic bidding service can collect payment information, shipping information, and so forth. Upon finding an offer that satisfies the needs of the user, the electronic bidding service can automatically apply the bidding information to consummate the transaction, without necessarily incurring any interaction with the buyer.

Additional exemplary implementations and attendant benefits are described in the following.

Figure 1:
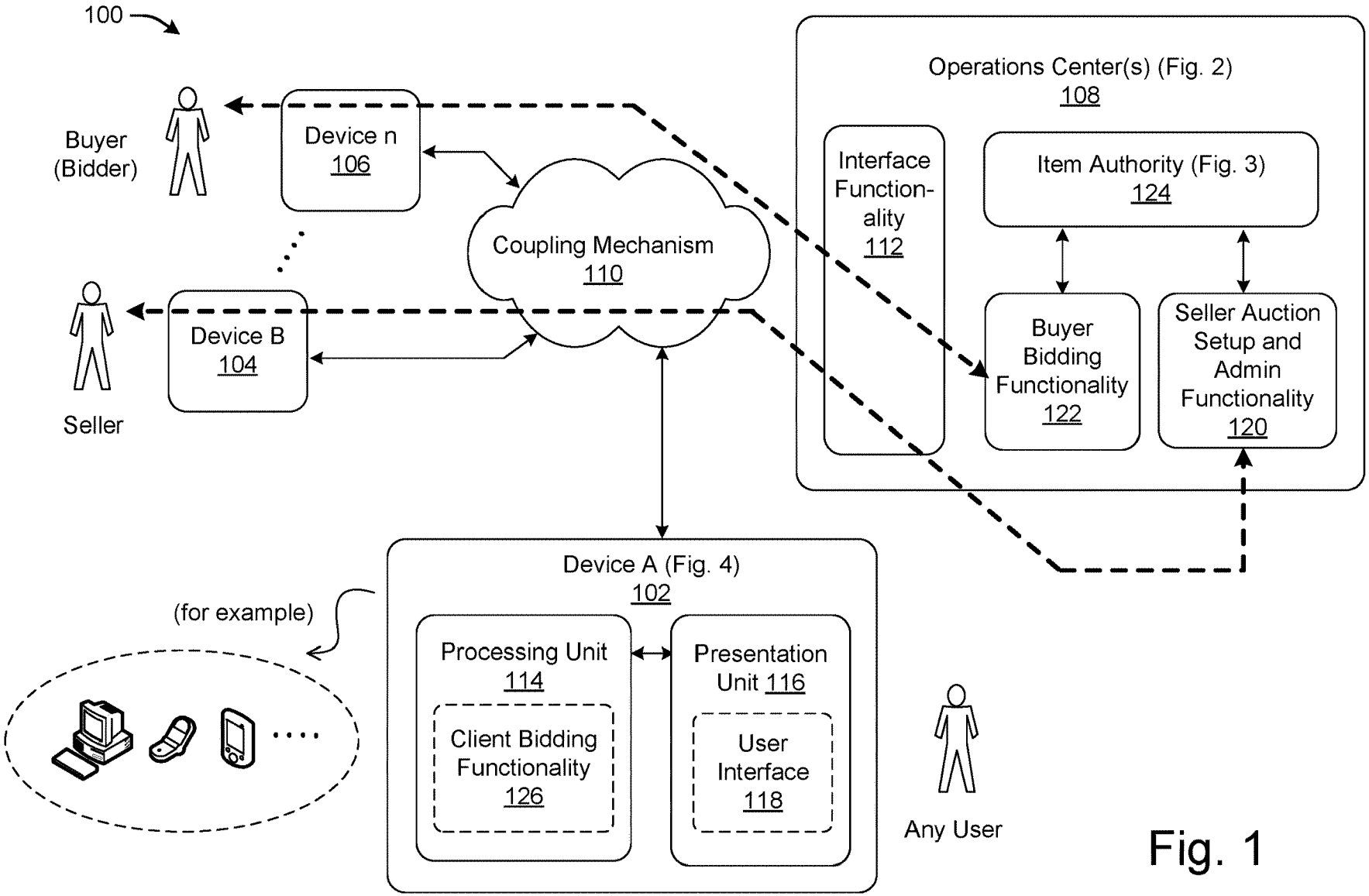
FIG. 1 shows an exemplary electronic bidding service, including an operations center coupled to a plurality of client devices.

The same numbers are used throughout the disclosure and figures to reference like components and features. Series 100 numbers refer to features originally found in FIG. 1, series 200 numbers refer to features originally found in FIG. 2, series 300 numbers refer to features originally found in FIG. 3, and so on.

DETAILED DESCRIPTION

This disclosure sets forth an electronic bidding service. In an electronic bidding service, one or more sellers make "seller offers" (or simply "offers" herein) to sell items if predefined conditions are met. One or more buyers (also referred to as bidders herein) place bids to purchase (or more generally, acquire) the items being sold by the sellers. The information that a seller submits to create an offer corresponds to "offer information." The information that a buyer submits place a bid corresponds to "bidding information."

A buyer expresses his or her intent to purchase or otherwise acquire an item in different ways in different respective bidding scenarios. The term electronic bidding service can correspond to competitive bidding scenarios in which plural potential buyers compete to acquire an item (otherwise known as an auction). Exemplary competitive bidding scenarios include offers involving open bids, closed bids, forward-bidding rules, reverse-bidding rules, and so on. Further, the term electronic bidding service encompasses a scenario in which a seller offers an item for a fixed price, and contracts to sell the item at the fixed price to the first bidder who bids the full price.

The term item refers to any kind of discrete resource, such as any kind of tangible or intangible product (including an informational resource), a service, and so forth.

This disclosure includes the following sections. Section A describes an exemplary electronic bidding service for conducting the electronic bidding service. Section B describes exemplary procedures that explain the operation of the electronic bidding service. And Section C describes exemplary user interface presentations that can be provided by the electronic bidding service.

A. Exemplary Systems (FIGS. 1-4)

As a preliminary matter, the terms logic, module, or functionality generally represent hardware, software or a combination of hardware and software, or any other kind of implementation. For instance, in the case of a software implementation, the terms logic, module, or functionality represent program code or other instructions that perform specified tasks when executed on a processing device or devices (e.g., CPU or CPUs). The program code can be stored in one or more machine-readable media.

The term machine-readable media or the like refers to any kind of medium for retaining information in any form, including various kinds of storage devices (magnetic, optical, static, etc.). The term machine-readable media also encompasses transitory forms of representing information, including various hardwired and/or wireless links for transmitting the information from one point to another.

A.1. System Overview

FIG. 1 shows an overview of one exemplary electronic bidding service 100. In this electronic biding service 100, a plurality of devices (102, 104, . . . 106) are coupled to an operations center 108 by a coupling mechanism 110. The operations center 108 generally performs a bidding operation to be described below, in which participants may use devices (102, 104, . . . 106) to submit offers and bids. In the exemplary scenario shown in FIG. 1, an exemplary seller device 104 interacts with the operations center 108 to add an item to the electronic bidding operation being conducted by the operations center 108. In the terminology used herein, this action constitutes creating an offer for the item. The information that makes up an offer is referred to as "offer information" herein.

An exemplary buyer (or bidder) uses a device, such as device 106, to enter a bid for a desired item. The information entered by the buyer is referred to as "bidding information" herein. The bidding information which specifies salient bidding information regarding the item that the buyer wishes to acquire, as well as other stipulated conditions pertaining to the acquisition of the item. Based on the bidding information entered by the buyer, the operations center 108 automatically investigates the offer information established by the sellers to acquire, if possible, the desired item for the buyer.

The operations center 108 can generally represent equipment maintained by a merchant, although the principles described herein can be implemented by any other kind of arrangement. For instance, in another implementation, the operations center 108 can be administered by an entity on behalf of one or more independent merchants. In terms of physical implementation, the operations center 108 can be implemented as one or more server computers (e.g., as a "farm" of such computer servers) and associated databases. The architecture of the operations center 108 can be separated into front-end components that interface directly with the devices (102, 104, . . . 106) and back-end components that can perform offline analysis. For instance, the operations center 108 can implement the front-end components using interface functionality 112, in which case the remainder of the components of the operations center 108 (to be described below) constitutes a back-end system. Generally, the components of operations center 108 can be located at a single site, or distributed over plural sites.

The devices (102, 104, . . . 106) represent any kind of electronic unit which can interact with the operations center 108 via the coupling mechanism 110 (discussed below). In the most common case, the devices (102, 104, . . . 106) correspond to computer devices, such as personal computers, laptop computers, and so forth. But any of the devices (102, 104, . . . 106) may also correspond to any kind of wearable computer, a mobile telephone, a Personal Digital Assistant (PDA) device, a stylus-type input device, a game console device, and so forth. In any event, a device, such as exemplary device 102, can comprise a processing unit 114 and a presentation unit 116. The processing unit 114 generally corresponds to functionality (e.g., software logic, and/or circuitry, etc.) for processing information. The presentation unit 116 generally corresponds to functionality (e.g., software logic, and/or circuitry, etc.) for presenting the processed information. For example, the presentation unit 116 can present a graphical user interface 118 for interacting with the user.

The coupling mechanism 110 can correspond to any kind of communication conduit or combination of communication conduits. In the case most commonly evoked in this disclosure, the coupling mechanism 110 corresponds to a wide area network, such as the Internet. However, the coupling mechanism 110 can alternatively, or in addition, comprise other kinds of communication conduits, such as an intranet, point-to-point coupling arrangement, and so forth. In any case, the coupling mechanism 110 can include any combination of hardwired links, wireless links, routers, repeaters, gateways, name servers, and so forth (not shown), governed by any protocol or combination of protocols.

The operations center 108 includes various functionality for conducting the electronic bidding service 100, including seller setup and administration functionality 120 (referred to as "setup functionality" for brevity), and buyer bidding functionality 122 (referred to as "bidding functionality" for brevity). The setup functionality 120 allows sellers to create offers for items in the electronic bidding service 100, to thereby supply offer information. The bidding functionality allows the buyers to bid on items offered by sellers and to acquire items if their bids are successful.

The operations center 108 also includes an item authority 124. The item authority 124 comprises a database (or databases) in association with functionality for interacting with the database(s). As will be more fully set forth in connection with FIG. 3, the item authority's 124 database provides master reference information associated with each of the items that the sellers place into the electronic bidding service 100. As the name suggests, the master reference information can provide definitive reference codes associated with the items. The operations center 108 uses the master reference information to identify whether two or more offers defined by respective sellers pertain to the same item. That is, offers are considered to feature the same item if these offers are linked to the same master reference information. As described below, the knowledge that two or more offers pertain to the same item is useful because it allows the operations center 108 to automatically place bids on these offers (in series or simultaneously) without any interaction with the buyer (or with reduced interaction with the buyer).

One or more functions implemented by the operations center 108 associated with the electronic bidding service 100 can alternatively, or additionally, be performed on the local level at the client devices (102, 104, . . . 106). To this end, FIG. 1 shows that exemplary device 102 can include optional client-side bidding functionality 126.

The following subsections provide additional details regarding selected components shown in FIG. 1.

A.2. Exemplary Operations Center

Figure 2:
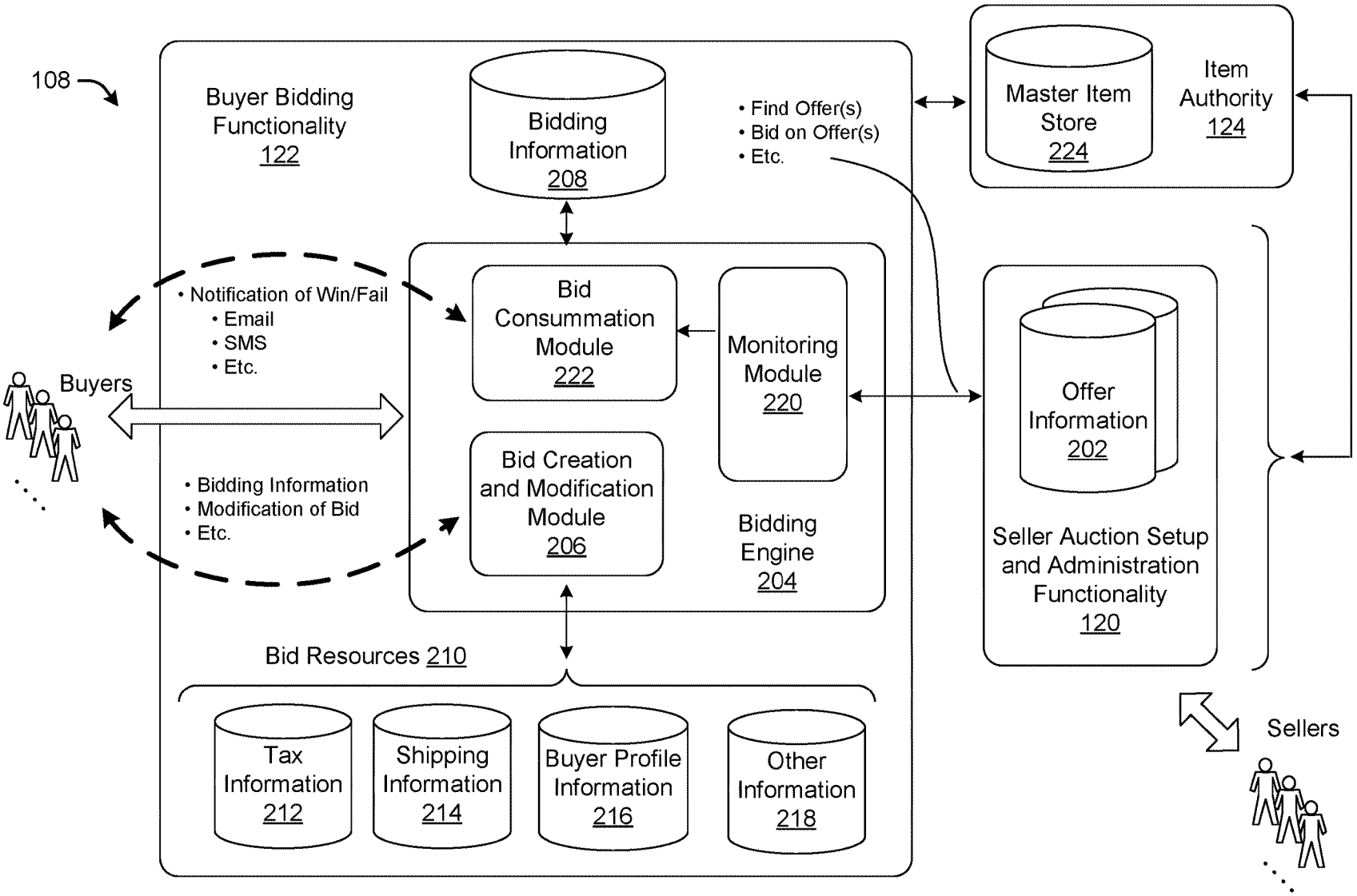
FIG. 2 shows exemplary bidding functionality for use in the operations center of FIG. 1.

FIG. 2 shows exemplary features of the operations center 108. It will be appreciated that the operations center 108 may perform many functions, only a subset of which is relevant to the administration of the electronic bidding service 100. Hence, FIG. 2 shows only those components of the operations center 108 which are pertinent to the focus of this disclosure.

The operations center 108 includes the principal components introduced in the context of FIG. 1, namely the setup functionality 120, the bidding functionality 122, and the item authority 124.

Starting with the setup functionality 120, this functionality allows sellers to define offers to sell items. A seller may define an offer in various ways depending on different electronic bidding service paradigms. In one case, the seller can define an offer by supplying a textual and/or pictorial (e.g., photographic) description of the item. The seller can also specify salient information regarding the sale of the item, such as a minimum bid amount for which the seller will sell the item, the time period in which the item will be placed on sale, and so forth. In any event, the information supplied by the sellers defines offer information which is stored in an offer information store 202. In one implementation, the offer information store 202 may comprise two or more separate databases of information, such as a first database for storing offer information pertaining to fixed price offers and a second database for storing offer information pertaining to competitive-bid offers.

According to a first general scenario, the bidding functionality 122 can receive a bid by a buyer that targets a specific offer. According to a second general scenario, the bidding functionality 122 can also perform offer-agnostic searches for offers which match general bidding criteria specified by the buyer. For instance, the buyer may enter bidding criteria that specifies the item that they wish to acquire, coupled with various conditions placed by the buyer that may constrain the acquisition. After the buyer initiates the bidding process, the bidding functionality 122 consummates the transaction (if possible) by purchasing (or more generally, acquiring) the item specified in the buyer's bid.

To function as described above, the bidding functionality 122 includes a number of modules, as shown in FIG. 2. To begin with, the bidding functionality 122 includes a bidding engine 204. The bidding engine 204 creates bids and attempts to satisfy the bids (by acquiring the items specified in the bids). The bidding engine 204 can interact with the buyers via the interface functionality 112 (of FIG. 1).

The bidding engine 204 includes a bid creation and modification module 206 (referred to as a "bid creation module" for brevity). As the name suggests, the purpose of the bid creation module 206 is to solicit and collect various bidding information from the buyer, and, in response, to create a bid for a selected item based on the bidding information. The bid creation module 206 can store the collected bidding information in a bidding information store 208.

More specifically, the bid creation module 206 can collect different kinds of bidding information depending on different bidding scenarios. In general, the bid creation module 206 can collect the following non-limiting and non-exhaustive types of information:

The item. The bidding information may describe the item that the buyer desires to acquire. In one case, the buyer can specify the item that the buyer wishes to acquire by identifying a specific offer that pertains to this item. In this context, the bidding functionality 122 will initially attempt to acquire the item from that specific offer (before optionally widening its search to other offers which may pertain to the same item). In another possible case, the buyer can identify the item in an offer-agnostic manner, that is, by entering information which defines the item without reference to any offer which may pertain to the item. In the offer-agnostic context, the bidding functionality 122 can search the offer information to determine if there are one or more offers which match the general criteria specified in the bidding information.

Price criteria. The bidding information may also specify price-related conditions, such as the maximum amount of money that the buyer is willing to spend on the item. In one case, such payment information comprises the maximum amount of money that the buyer is willing to spend on the item itself. In another case, such payment information comprises the maximum amount of money that the buyer is willing to spend for the overall transaction, which may include various shipping costs, tax costs, service charges, and so forth. The bidding functionality 122 can allow the buyer to specify how the price component of the buyer's bid should be interpreted.

Payment information. The bidding information may also specify payment information that defines the manner in which the buyer intends to pay for the item (e.g., credit card, debit from a prescribed account, etc.).

Shipping information. The bidding information may also specify shipping information that defines where to ship the acquired item, and how to ship the acquired item (e.g., using governmental mail carrier service, commercial courier service, etc.). Both the payment information and the shipping information constitute administrative information which allows the electronic bidding service 100 to consummate a bidding transaction. The payment information and the shipping information also potentially constitute constraints that can be used, along with other criteria, to select matching offers. For instance, if a buyer resides in Alaska, the shipping information entered by the buyer may eliminate any offers that preclude shipment to Alaska.

Miscellaneous criteria. The bidding information may also specify other conditions that place constraints on what constitutes an acceptable offer. For instance, the electronic bidding service 100 may rank different sellers based on the trustworthiness of the sellers. A buyer may define bidding information which specifies that the buyer only wishes to acquire the item from sellers having a rating above a specified threshold. The buyer can also specify the maximum amount of time that a bid should remain active. The buyer can also specify the desired condition of the item that the buyer wishes to acquire (e.g., new, good, fair, poor, etc.). The bidding information may include yet additional kinds of information.

In one case, certain bidding information may specify mandatory conditions that must be met in order for an offer to satisfy the bidding information. In other cases, certain bidding information may specify preferred conditions that the buyer prefers (but does not require) be met in order for an offer to satisfy the bidding information. For instance, in one case, the buyer may specify that he or she will only purchase items from a seller having a sufficiently reliable rating. In another case, the buyer may specify that he or she merely prefers to deal with a highly ranked seller, but in the event that there is a paucity of suitably trustworthy sellers, the buyer agrees to deal with a less reputable seller. The bidding functionality 122 can satisfy such preference-related criteria by ranking the offers based on the extent to which they satisfy the multiple criteria specified in the bidding information.

According to one exemplary provision, the bid creation module 206 collects sufficient information to proceed with the bidding process without interaction with the buyer, or with only minimal interaction with the buyer. In other words, the bidding process can proceed in a substantially automatic manner after the electronic bidding service 100 collects initial information from the buyer. A buyer may regard this provision as desirable because the electronic bidding service 100 does not burden the buyer with multiple requests for information during the course of the bidding process.

Figure 9:
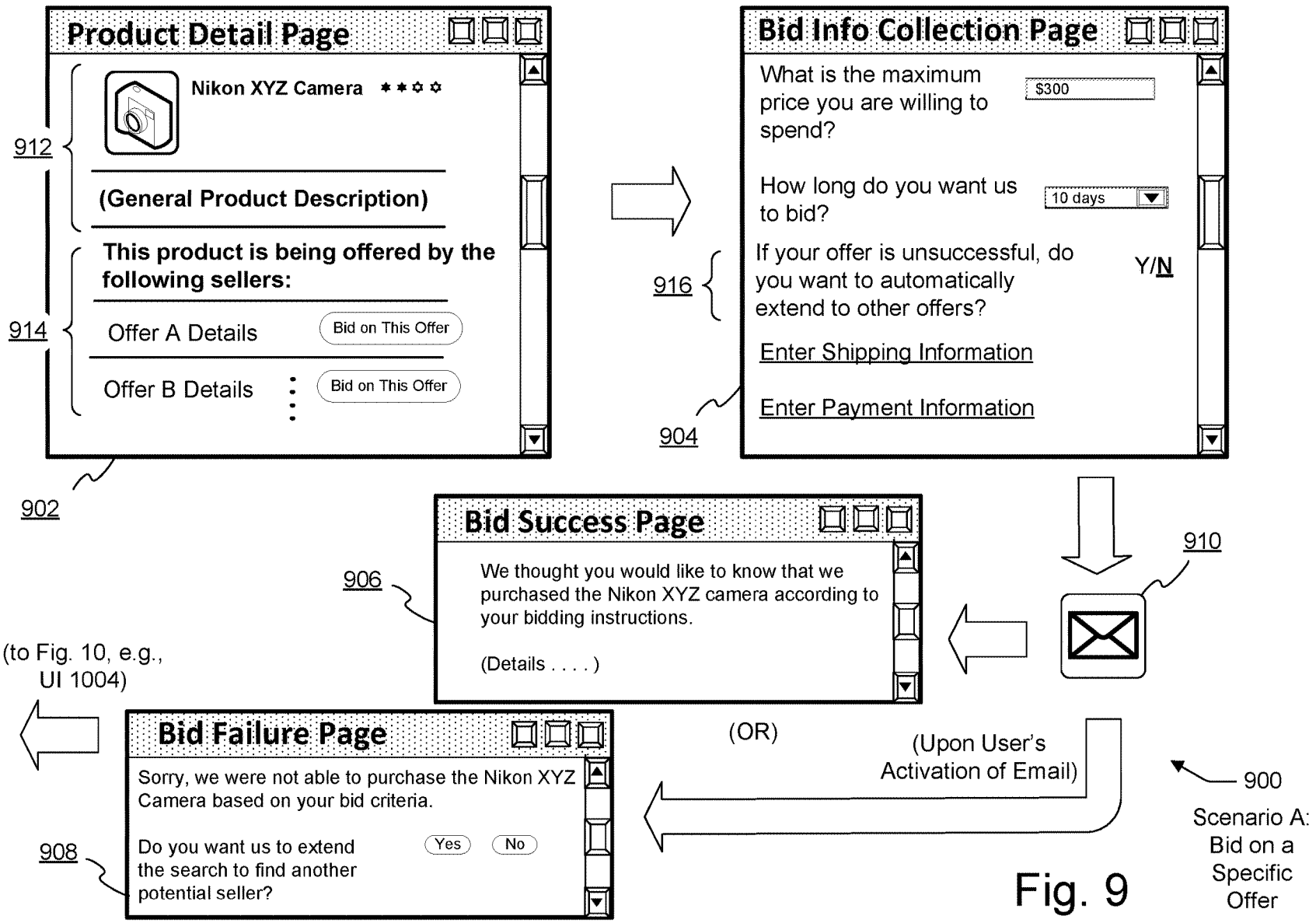
FIG. 9 shows an exemplary series of user interface presentations for use in association with the first scenario of FIG. 7.
Figure 10:
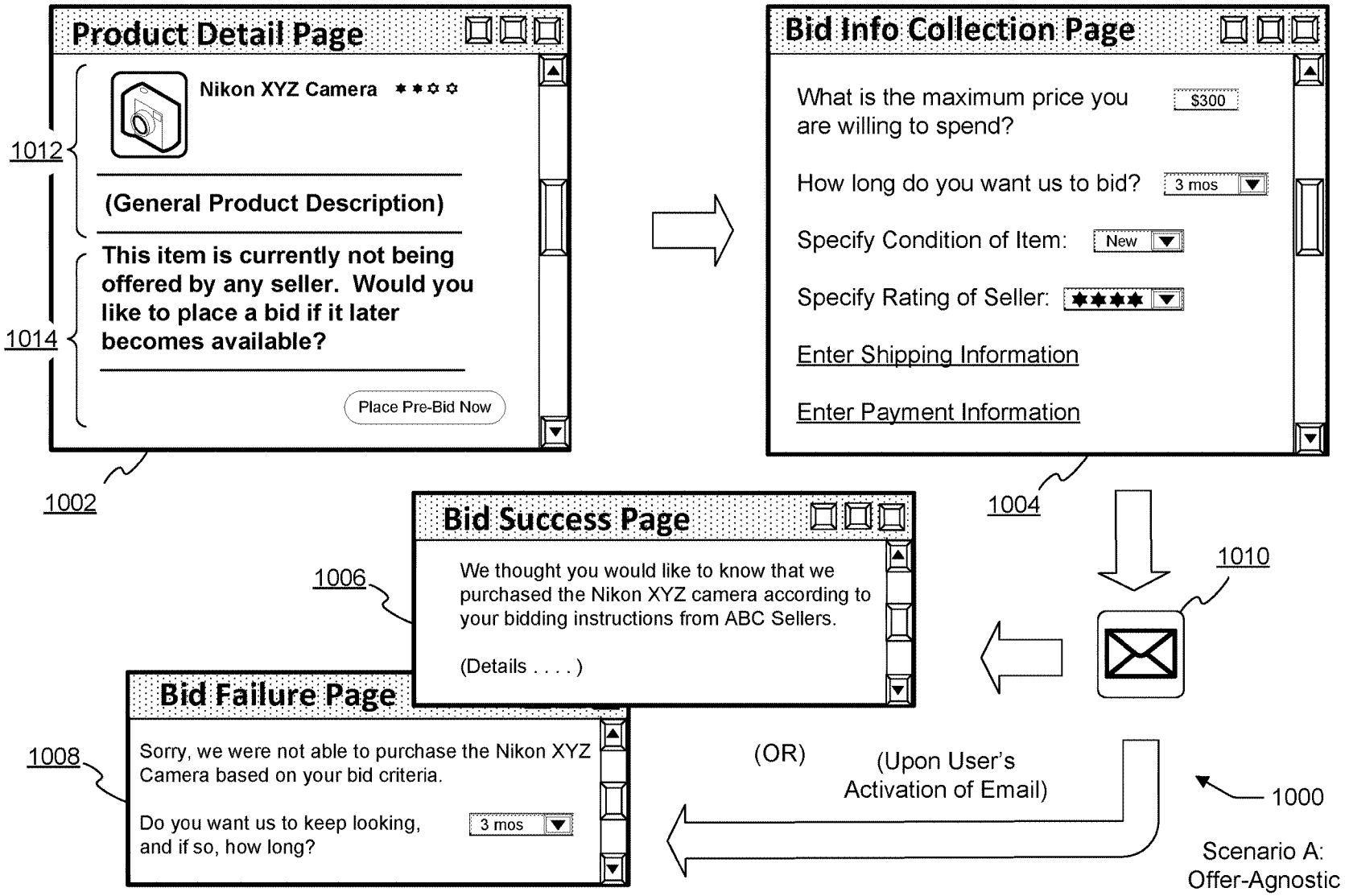
FIG. 10 shows an exemplary series of user interface presentations for use in association with the second scenario of FIG. 8

The interface module 118 can collect the above-described bidding information through one or more appropriately configured user interface presentations. FIGS. 9 and 10, to be discussed in turn, show exemplary user interface presentations that can be used by a buyer to create a bid. The bidding engine can store all collected bidding information in a bidding information store 208.

In addition to the above-described buyer-supplied bidding information, the bid creation module 206 can optionally also determine other kinds of bidding information (if possible). For instance, in one exemplary implementation, the bid creation module 206 can determine the shipping costs that are associated with supplying the desired item to the buyer. Further, the bid creation module 206 can optionally determine the tax costs associated with the purchasing the desired item for the buyer, e.g., based on the jurisdiction in which the buyer resides (and will receive the item), and so forth. The bid creation module 206 can determine yet other costs associated with the bidding transaction. The bid creation module 206 can add such determined bidding information to the bidding information store 208, along with the buyer-supplied bidding information.

The above-described cost-determination provision is useful for a number of reasons. First, the bidding engine 204 can notify the buyer of the various costs associated with using the electronic bidding service 100 during the creation of the bid. This better allows the buyer to decide whether it is prudent to proceed with the bid. In another implementation, the buyer specifies a maximum amount of money that the buyer authorizes to be spent for the entire bidding transaction, including shipping costs, tax costs, and/or any other transaction-related costs. In this case, the bid creation module 206 need not itemize these costs at the time of bid creation. But even in this case, the bid creation module 206 may optionally reveal these costs to the buyer (if sufficient information is available to compute these costs).

To determine the bidding information in the above-described manner, the bid creation module 206 can rely on various bid resources 210, including tax information 212, shipping information 214, buyer profile information 216, and various other kinds of information 216. The tax and shipping information (212, 214) can originate from various sources, such as various governmental sources, various commercial sources, various internal sources to the electronic bidding service 100, and so forth. The buyer profile information 216 can supply information regarding the buyers who interact with the electronic bidding service 100, such as billing and shipping information associated with the buyers, payment information associated with the buyers, and so forth.

After a bid has been created, a monitoring module 220 attempts to acquire an item which matches the criteria specified in the bidding information. For example, the monitoring module 220 may serve two roles. First, the monitoring module 220 may attempt to identify one or more offers which satisfy the criteria in the buyer's bidding information. Second, the monitoring module 220 may attempt to acquire the item from the identified offer(s). Moreover, each of these operations can be performed in different ways depending on the nature of the bidding paradigm that is being invoked (e.g., fixed price bidding, competitive bidding, etc.).

As to the first of the above-identified roles, in the case in which the buyer has identified a specific offer, the monitoring module 220 identifies the specific offer as the target of the bidding process. In the case in which the buyer has specified a desired item in an offer-agnostic manner (or in the case in which the buyer's bid was unsuccessful in securing the item from an initial identified offer), the monitoring module 220 attempts to satisfy the bid by generally searching the offer information for offers created by sellers which match the bidding information. In this role, the monitoring module 220 first attempts to find offers that pertain to the same item that the buyer wishes to acquire. Second, the monitoring module 220 attempts to narrow down the selection based on other criteria specified in the bidding information. For instance, the buyer may desire to deal with a seller with a reliability rating above a prescribed threshold. Thus, in this case, if there are multiple offers for the item desired by the buyer, the monitoring module 220 will select an offer from the most reliable seller.

It will be appreciated that the offer information in the store 202 dynamically changes as new offers are created and old offers are removed (e.g., in response to the purchase of the offered items, or other termination events). This means that a buyer's offer-agnostic bid may not immediately match up with any available offers, but may eventually match up with an offer when a seller adds a new offer which satisfies the bidding criteria specified in the bidding information. Thus, the monitoring module 220 can operate by periodically examining the offer information (e.g., once an hour, once a day, etc.), and determining whether the bidding information matches up with one or more new offers added to the offer information. This process can continue for a bidding interval specified by the buyer (such as one month, three months, six months, and so on).

As to the second role, once the monitoring module 220 has identified an offer that matches the bidding information, the monitoring module 220 attempts to acquire the item from that offer. The nature of this task differs depending on the type of bidding paradigm that is being invoked. In a fixed price bidding paradigm, the monitoring module 220 immediately purchases the item from the identified offer providing that the amount of money that the buyer has agreed to pay is equal to or greater than the fixed price specified in the offer.

In a competitive bidding scenario, the monitoring module 220 makes one or more bids for the item, which may vie with one or more bids entered by other buyers. In one case, the monitoring module 220 can enter a bid amount which is just above the prevailing highest bid. For instance, if the prevailing highest bid is $85.00, then the monitoring module 220 can enter a bid of $90.00 (providing that the $90.00 bid does not exceed a maximum amount of money that the buyer has agreed to bid in the bidding process). The monitoring module 220 can successively increase the bid amount to counter the competitive bids of other buyers. The monitoring module 220 can also place a bid at a time that is strategically determined to best acquire the item. For instance, the monitoring module 220 can place a bid that exceeds the prevailing highest bid just before the offer's bidding process is about to end. The monitoring module 220 can perform yet other operations to attempt to secure the item.

In one case, the monitoring module 220 can attempt to acquire the desired item from a series of offers in succession, that is, by bidding in one offer after the other. In another case, the monitoring module 220 can attempt to acquire the desired item by placing bids in multiple offers at the same time. To this end, the monitoring module 220 can apply various rules (set by the electronic bidding service 100 and/or by the buyer) to determine what offers it should pursue and how it should place bids for the selected offers. For instance, in one case, the buyer can manually select a group of n offers that the monitoring module 220 should place bids on. In another case, the electronic bidding service 100 can automatically select the n most suitable offers (e.g., based on a determination that these offers best satisfy the criteria specified in the bidding information). In either case, the monitoring module 220 can terminate the bidding process when any of the group of n bids proves successful, or based on other bid-termination considerations.

Yet other bidding strategies can be applied.

In any event, in performing the bidding operations described above, the monitoring module 220 can identify offers for the same item without necessarily requiring interaction with the buyer. The feature which makes this possible is the item authority 124. For instance, consider the scenario in which the buyer first places a bid on a specific offer that features a desired item. In advance of the bidding operation, the item authority 124 has already associated all offers that pertain to this desired item with the same master reference information. If the bid placed on the specific offer is not successful in acquiring the item, then the monitoring module 220 can automatically identify one or more other offers that feature the same item by finding offers that are associated with the same master reference information. Consider next the scenario in which the buyer places a bid for the desired item but does not identify any offers that feature this item. In this case, the monitoring module 220 can again identify one or more offers which feature the desired item by searching for any offers which are associated with the master reference information assigned to the desired item.

In one exemplary implementation, the master reference information is expressed as a unique code assigned to the item. In this case, the task of finding two or more offers associated with the same item takes the form of a code-matching operation. That is, this operation comprises determining that the master reference information code assigned to the desired item is Z, and then finding all other offers which are associated with the code Z.

Finally, a bid consummation module 222 consummates a bidding transaction when the monitoring module 220 indicates that one or more offers match the bidding criteria specified in the bidding information. The bid consummation module 222 can perform this role in different ways, such as by coordinating the shipping of the item, charging relevant costs to the buyer, and so on.

The bid consummation module 222 can also send various notifications to the buyer. For instance, upon an indication of a successful bid, the bid consummation module 222 can rely on the interface module 112 (of FIG. 1) to send the buyer an email notification. The buyer can activate a link specified in the email notification to receive details regarding the transaction that has taken place. The bid consummation module 222 can also notify the buyer when her bid proves to be unsuccessful for various reasons. As will be described in detail below, such a notification can also give the buyer the option of extending the bidding process in various ways. FIGS. 9 and 10, to be discussed in turn below, show a collection of exemplary user interface presentations that can be used to notify the buyer of various post-bid-creation events, and to optionally solicit additional information from the buyer.

Alternatively, or in addition, the bid consummation module 222 can communicate with the buyer via other mechanisms, such as instant messaging, mobile telephone or pager notification (e.g., SMS messaging), conventional mail or courier service, and so on. The bidding engine 204 can also allow the buyer to proactively investigate the status of her bids, e.g., by allowing the buyer to access a user account.

To function as described above, the item authority 124 includes a master item store 224. The master item store 224 includes a plurality of master reference information entries corresponding to items that the sellers are selling through the electronic bidding service 100, as reflected in the offer information (stored in the offer information store 202). Each master reference information entry serves as authoritative information used to identify the item. To repeat, the master reference information is used to identify whether two or more offers are actually describing the same item. That is, two or more offers are considered to describe the same item when these two offers are associated with the same master reference information. This knowledge, in turn, allows the monitoring module 220 to transition from one offer to next in an attempt to acquire a desired item (that is, by identifying a second offer which shares the same master reference information as a first-selected offer). This knowledge can also allow the monitoring module 220 to identify a group of offers which feature the same item on which multiple simultaneous bids can be placed (again, by identifying two or more offers that share the same master reference information).

Figure 3:
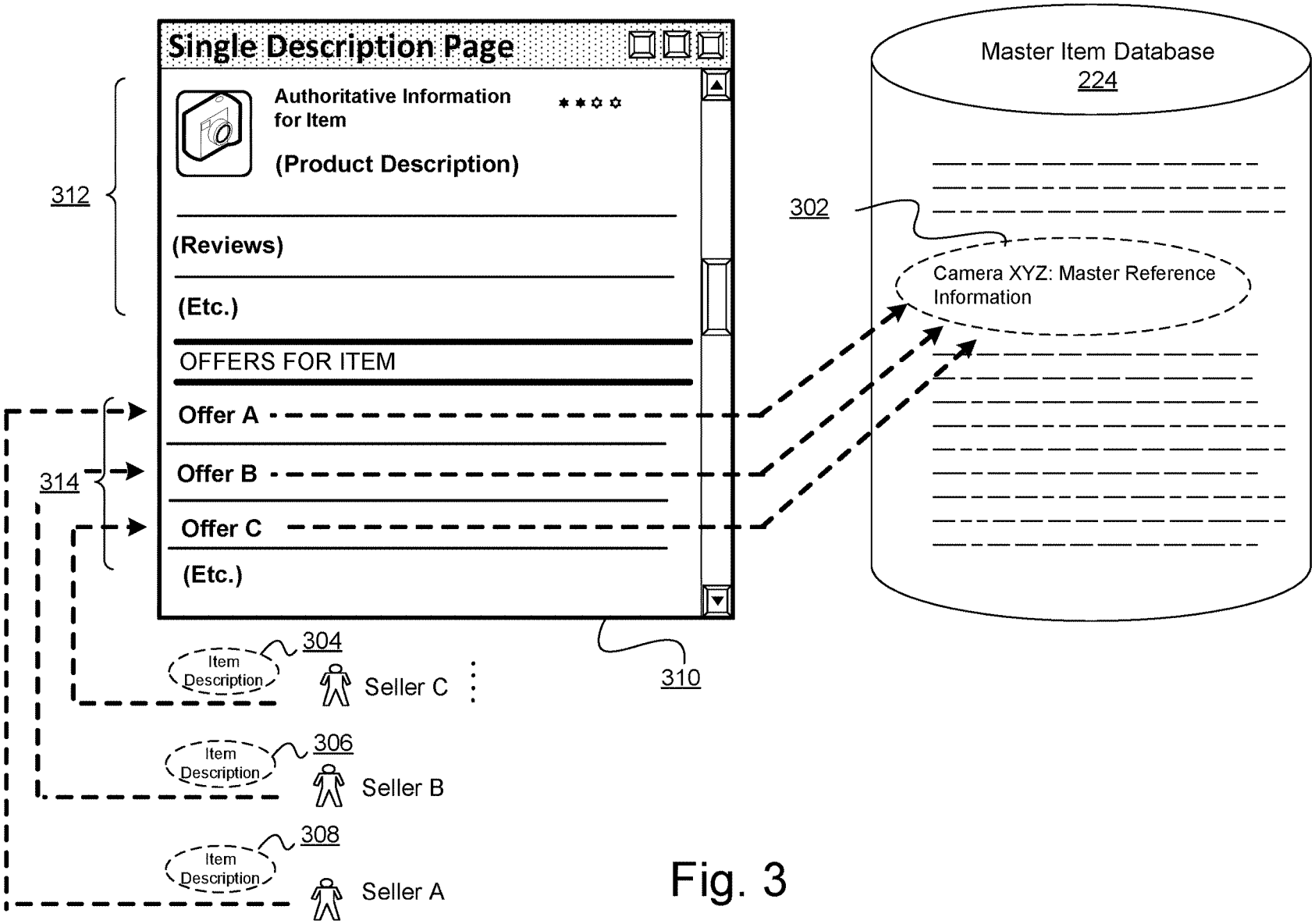
FIG. 3 shows a master item database for use in the operations center of FIG. 1.

FIG. 3 illustrates the nature of the master item store 224 in further detail. In the illustrated scenario, assume that the master item store 224 includes a plurality of master reference information entries. One entry 302 identifies a particular camera produced by a certain manufacturer of cameras. Such reference information entry 302 can comprise a unique alpha-numeric code assigned to the item, or other identifying indicia. In one case, the master reference information for a particular item may comprise an ASIN code, a UPC code, an ISBN code, and so forth. The code may be an industry-recognized code or a proprietary (e.g., non-standard) code that is created by an entity which administers the electronic bidding service 100 (or by some other entity).

As mentioned above, the master reference information serves to link together different offers that happen to be selling the same item. Consider the case shown in FIG. 3, in which three different sellers wish to sell the same item. According to the process described below (with reference to FIG. 5), the sellers can initially supply their own respective offers with descriptions of the item to the setup functionality 120. These descriptions may differ in various respects. As will be described below, the setup functionality 120 can interact with the item authority 124 to determine that all three offers pertain to the same item. As a result, the setup functionality 120 can associate all three of these offers with the same master reference information 302.

The electronic bidding service 100 can communicate different offers to the buyer in different ways. In one technique, the bidding engine 204 can provide a single description page 310 associated with the item. This page 310 provides a single description of the item, while also displaying the various offers for this item that have been submitted by different sellers. More particularly, in one exemplary implementation, the page 310 may include a first field 312 of general information that pertains to the item, such as a description of the item, reviews of the item, and so forth. In the illustrated embodiments, this field 312 does not include information which is specific to any offer that features the item. Rather, a second field 314 includes specific information regarding each offer from a seller that is associated with the item. For instance, field 314 may include, for each offer, information regarding the cost-related terms of the offer (such as a fixed price associated with a fixed-price offer, a prevailing highest bid for a competitive-bid offer, etc.), the condition of the item (such as good, fair, poor, etc.), and so on. The selection and organization of information presented in the page 310 is exemplary and non-limiting. Other implementations can convey the same information in different ways. Further exemplary information regarding the use of a single description page can be found in published U.S. Patent Application No. 2003/0083961, published on May 1, 2003, which is incorporated herein by reference in its entirety.

In yet another implementation, the electronic bidding service 100 can provide separate user interface pages corresponding to separate offers. Each of these pages can include a unique description of the item as well as unique offer criteria. Still further strategies are possible for visually conveying offers to the buyer.

Having set forth exemplary features of the item authority 124, the exemplary benefits of this component will now be set forth. In one case, if the buyer searches for a specified item (e.g., by identifying sufficiently detailed information to pinpoint a particular item from among other similar items), the monitoring module 220 can supply, with a high degree of confidence, a list of offers that include the item by identifying offers that share the same master reference information. The buyer can thereby be assured that all of the offers pertain to the desired item without having to independently read and interpret the descriptions of each of the offers (if, in fact, the electronic bidding service 100 allows the sellers to create separate descriptions).

According to another benefit, the use of the item authority 124 facilitates automation of the bidding process. This is because, once the buyer has pinpointed the item that he or she desires to acquire, the monitoring module 220 can find matching offers within the offer information in the offer information store 202 without further interaction with the buyer, or with only minimal interaction with the buyer. Again, the monitoring module 220 performs this role by examining the offer information for offers that specify the master reference information associated with the item that the buyer desires to acquire.

In one case, the buyer may initiate the search by asking the bidding functionality 122 to first attempt to acquire the item from a selected offer. If that bid proves unsuccessful, the buyer can instruct the bidding functionality 122 to widen its search to other offers that pertain to the same item (where such instruction can be given by the buyer before the bidding process begins or after an initial bid proves unsuccessful). In another case, the buyer may initially identify the desired item in an offer-agnostic manner, leaving it to the bidding functionality 122 to find one or more offers that meet the buyer's bidding criteria. The bidding module 220 relies on the master reference information in both of these cases by identifying same-item offers without interaction with the buyer or with only minimal interaction with the buyer.

The electronic bidding service 100 can provide other techniques for linking different offers. For example, the item authority 124 can link together offers that pertain to merely similar items, rather than identical items. Similarity can be gauged in different ways. In one technique, the item authority 124 can rely on a predetermined subject matter classification scheme to determine whether one item is related to another. For example, the item authority 124 (or other module) may maintain a subject matter classification hierarchy that identifies that a CD featuring the music of Bach is related to a CD featuring the music of Vivaldi, insofar as both of these CDs pertain to baroque music. In another technique, the item authority 124 can rely on empirical data to make this determination; namely, the item authority 124 can ascertain that an item X is related to an item Y if a significant number of individuals who purchased item X also purchased item Y. In any case, the item authority 124 can record these kinds of relationships in the master item store 224 or in some other store. Such relationships can be represented as attributes, linked lists, etc.

The monitoring module 220 can use information regarding related offers in its attempt to find an offer which satisfies bidding information input by a buyer. For example, assume that a buyer selects an initial offer for an item having a defined master reference information code. The monitoring module 220 may first attempt to procure this item from the identified offer. If that proves unsuccessful, the monitoring module 220 may then attempt to find another offer that features the same item (based on the fact that this other offer is associated with the same master reference item code). If this option also proves unsuccessful, the monitoring module 220 can consult the master item store 224 to determine the master reference information code(s) of one or more items that are related to the initially-selected item. For example, the master item store 224 can identify that the master reference code assigned to the desired item is Z, and the master reference codes of items that are related to the desired item are L, M, and N. The monitoring module 220 can then attempt to find offers for related items associated with the identified related codes (e.g., codes L, M, and N).

A.3. Exemplary Computer Device

Figure 4:
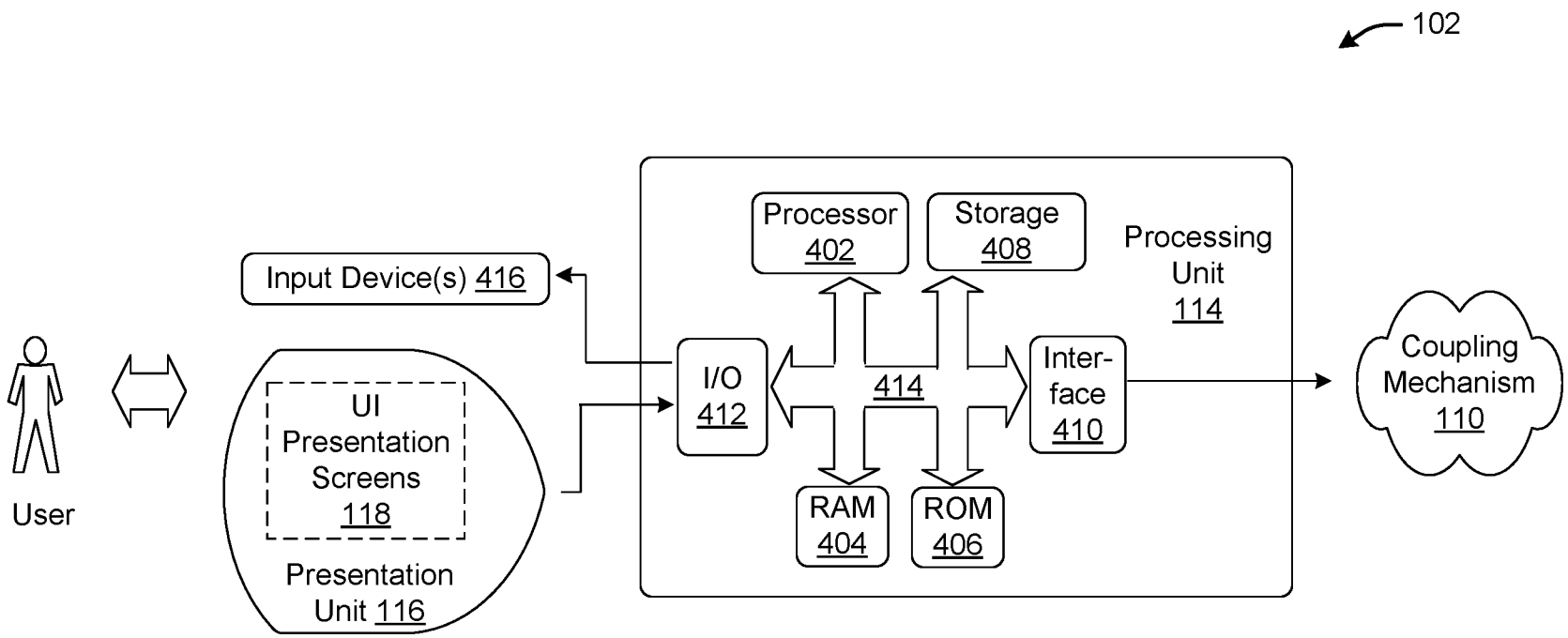
FIG. 4 shows an exemplary client device for use in the electronic bidding service of FIG. 1.

FIG. 4 shows an exemplary architecture of computer equipment which can be used to implement various aspects of the electronic bidding service 100 shown in FIG. 1, such as any one of the devices (102, 104, . . . 106), the operations center 108, any component of the operations center 108, and so forth. However, to facilitate explanation, FIG. 4 specifically shows the use of a computer device to implement the representative device 102. The device 102 can correspond to any kind of conventional computer device, but can also correspond to any other kind of unit having processing and presentation capabilities (e.g., a PDA device, mobile telephone, game console, and so forth).

The processing unit 114 of device 102 can comprise one or more processing components 402 (such as a CPU, neural network, etc.), RAM 404, RAM 406, media components 408 (such as a hard drive, DVD drive, etc.), network interface 410 (such as a telephone or cable modem, broadband connectivity mechanism, etc.), and an I/O interface 410 for interacting with input devices and output devices. One or more buses 414 couple the above-described components together.

The output device(s) can include the presentation unit 116, which presents the graphical user interface 118. The input device(s) 416 can include any one or more of a keyboard, mouse input device, track ball input device, joystick input device, and so forth.

The client bidding functionality 122 can be implemented as machine-readable instructions that reside in any storage unit or combination of storage units shown in FIG. 4. The processor 402 executes these instructions to produce desired operations pertaining to the electronic bidding service 100. (Similarly, in those cases in which the computer equipment shown in FIG. 4 is used to implement the operations center 108, or some component thereof, the center's 108 various functions can be implemented as machine-readable instructions that reside in any storage unit or combination of storage units shown in FIG. 4, and the processor 402 can execute these instructions to produce desired operations pertaining to the electronic bidding service 100.)

B. Exemplary Procedures (FIGS. 5-8)

FIGS. 5-8 describe the operation of the electronic bidding service 100 of FIG. 1 in flow chart form. To facilitate discussion, certain operations are described as constituting distinct blocks performed in a certain order. Such implementations are exemplary and non-limiting. Certain blocks described herein can be grouped together and performed in a single operation, and certain blocks can be performed in an order that differs from the order employed in the examples set forth in this disclosure. The blocks shown in the flowcharts can be implemented by software, hardware, a combination of software and hardware, or by other technology, or by manual processing.

B.1. Creating an Offer to Sell an Item

Figure 5:
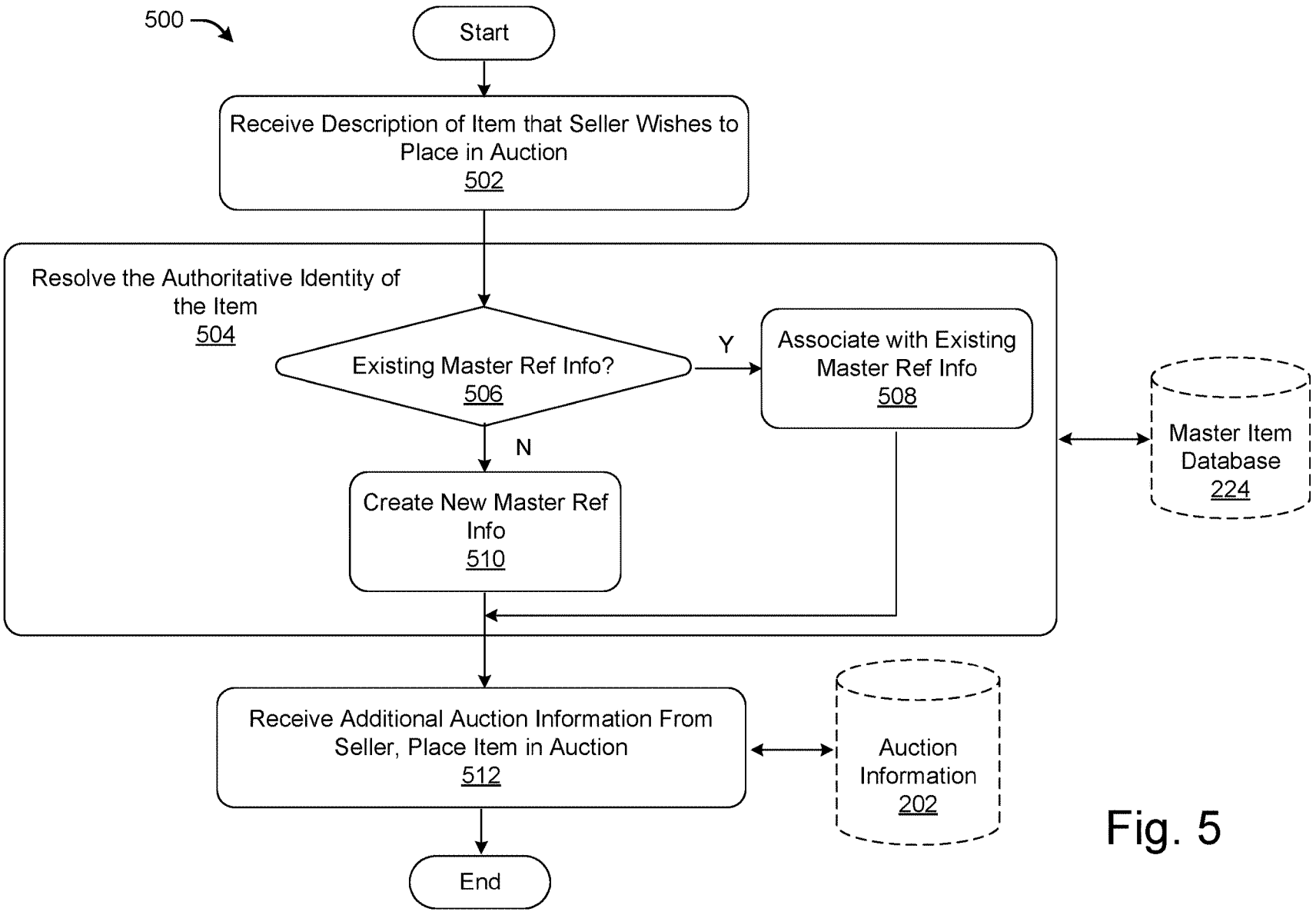
FIG. 5 shows an exemplary procedure for creating an offer for an item, including a sub-procedure for determining master reference information associated with the item.

FIG. 5 shows a procedure 500 for establishing an offer to sell a particular item in the electronic bidding service 100. In the context of FIG. 1, this procedure 500 defines one exemplary protocol by which the sellers can interact with the setup functionality 120.

In block 502, the setup functionality 120 receives information from the seller that defines the nature of the offer that the seller wishes to create. First and foremost, this information describes an item (or items) that the seller wishes to sell through the electronic bidding service 100. In actual practice, the seller can define the item in any number of ways, such as by supplying a textual description of the item, a photograph or other pictorial representation of the item, one or more codes associated with the item, attributes associated with the item, reviews associated with the item, and so forth. In one case, the seller can specify the item in a relatively unambiguous manner, e.g., by specifying unique codes associated with the item, or by identifying a single description page (e.g., page 310 of FIG. 3) associated with the item, and so on. In other cases, the seller may be forced to rely on less precise methods (meaning, for example, more subjective methods) to describe the item.

In one case, a seller can describe each item that the seller wishes to sell on an item-by-item basis. In another case, a seller can upload, in bulk, a plurality of descriptions for a corresponding plurality of items that the seller wishes to sell. The latter scenario is particularly appropriate in those cases in which the seller is a commercial merchant of goods or services, and wishes to sell an entire inventory of items through the electronic bidding service 100. The setup functionality 120 can provide various interface functionality for enabling sellers to supply item descriptions, such as various web interface pages, file uploading mechanisms, and so forth.

In the general block 504, the setup functionality 120 determines the master reference information corresponding to the item specified in the offer. This procedure can comprise, in block 506, first determining whether the item specified in the offer corresponds to an existing master reference information entry in the master item store 224. If so, in block 508, the setup functionality 120 associates the item specified in the offer with the existing master reference information entry. This association can be established by adding the master reference information entry to the description of the item in the offer, or by establishing a link between the offer and the master reference information entry, or by including the offer as an entry in a single description page associated with the item, or by some other means. In block 510, if the setup functionality 120 determines that the item specified in the offer does not have a counterpart master reference information entry, then the setup functionality 120 creates a new master reference information entry for the item and stores this new entry in the master item store 224. Block 510 also involves creating a *nexus* between the new master reference information and the seller's offer in the manner described above.

Block 504 may also generally involve sending a query to the seller to collect additional information in those cases in which the identity of the featured item cannot be ascertained with a reasonable degree of confidence.

Block 504 can be implemented in different ways depending on a number of environment-specific factors. In one case, the electronic bidding service 100 can associate item information specified in a bid with master reference information using a fully manual process. In this procedure, one or more trained analysts can manually examine the description specified in the offer, and determine the true identity of the item based on human judgment. In another case, the electronic bidding service 100 can associate item information specified in a bid with master reference information using a fully automatic process (if possible in view of the nature of the item being offered). In this procedure, an automated analysis engine can automatically compare the information specified in the offer with known information corresponding to already identified items. For instance, where a certain item can be uniquely identified by an industry code associated with the item, the engine can automatically identify and extract such code from the offer (if present therein) and map this code to a master reference information entry (comprising a pre-existing entry if it has already been created, or a new entry if it has not already been created). More advanced tools for performing this kind of analysis comprise various rule-based analyses, artificial intelligence analyses, neural network analyses, and so forth. In yet a third scenario, the electronic bidding service 100 can associate item information specified in a bid with master reference information using a procedure that is partly automated and partly manual in nature. For instance, in this procedure, automated analysis can be performed to make a first pass classification of an offer. Then, a human analyst can examine the results of the automated analysis to provide correctives, if appropriate. Still further implementations are possible.

In those cases in which automated analyses are employed, the automated analyses can incorporate a mechanism to learn based on the assessed accuracy of its classifications, and to thereby improve its ability to classify items over time. For instance, administrators and/or buyers can report misclassified items. The automated analyses can use this feedback to improve their ability to classify these same items when they encountered again upon the introduction of new offers.

Finally, in block 512, once the setup functionality 120 has classified the item, the setup functionality 120 can collect supplemental information regarding the offer, such as the minimum price that the seller is willing to sell the item, the condition of the item, and so on. After creating the offer in this manner, in block 512, the setup functionality 120 can place the offer into the offer information store 202 to provide offer information (where the offer information describes the offer). At this point, the offer can be matched against bids. Accurate matching is better ensured through the use of the above-described master reference information.

B.2. Entering Bidding Information to Acquire an Item

Figure 6:
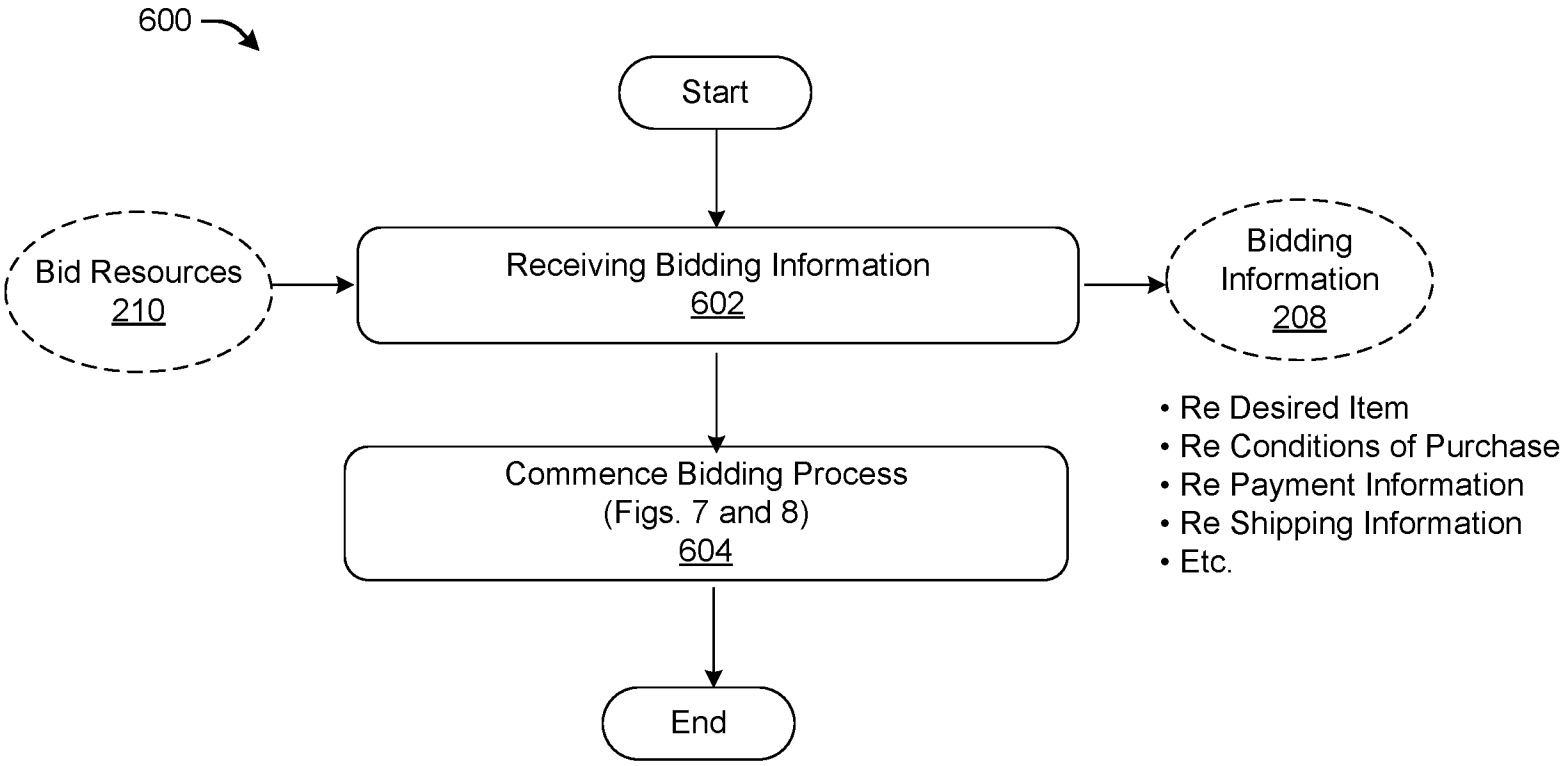
FIG. 6 shows an exemplary procedure for defining bidding information.

FIG. 6 shows a procedure 600 for collecting bidding information that defines a bid created by a buyer. As previously discussed, the bid specifies an item that the buyer wishes to purchase (or otherwise acquire), along with other salient information which defines the conditions pertaining to the acquisition.

In block 602, the bid creation module 206 (of FIG. 2) receives bidding information from the buyer, e.g., through one or more user interface presentations which solicit information from the buyer. As previously described at length in the previous section, the bidding information may specify the item that the buyer wishes to acquire, the price that the buyer is willing to pay for the item, and other potential conditions pertaining to the acquisition of the item. The bid may direct the bidding functionality 122 to attempt to secure the item from a specific offer, at least initially. Or the bid may instruct the bidding functionality 122 to attempt to find the item from any offer. In any case, the bidding information thus supplied is fed into the bidding information store 208.

In block 602, the bid creation module 206 can also optionally automatically determine other bidding information. For instance, the bid creation module 206 can pre-calculate shipping costs associated with acquiring the item, tax costs associated with acquiring the item, and so on. In performing this task, the bid creation module 206 can rely on a variety of bid resources 210 (enumerated in FIG. 2 as the tax information 212, shipping information 214, buyer profile information 216, and other information 218). The bid creation module 206 supplies the results of its calculations to the bidding information store 208.

In one case, the bid creation module 206 creates a bid in response to the above-described information input by the buyer and/or the information that is automatically calculated by the bid creation module 206. The bid itself can comprise a data structure or other collection of information having predefined fields for receiving bidding information.

Figure 7:
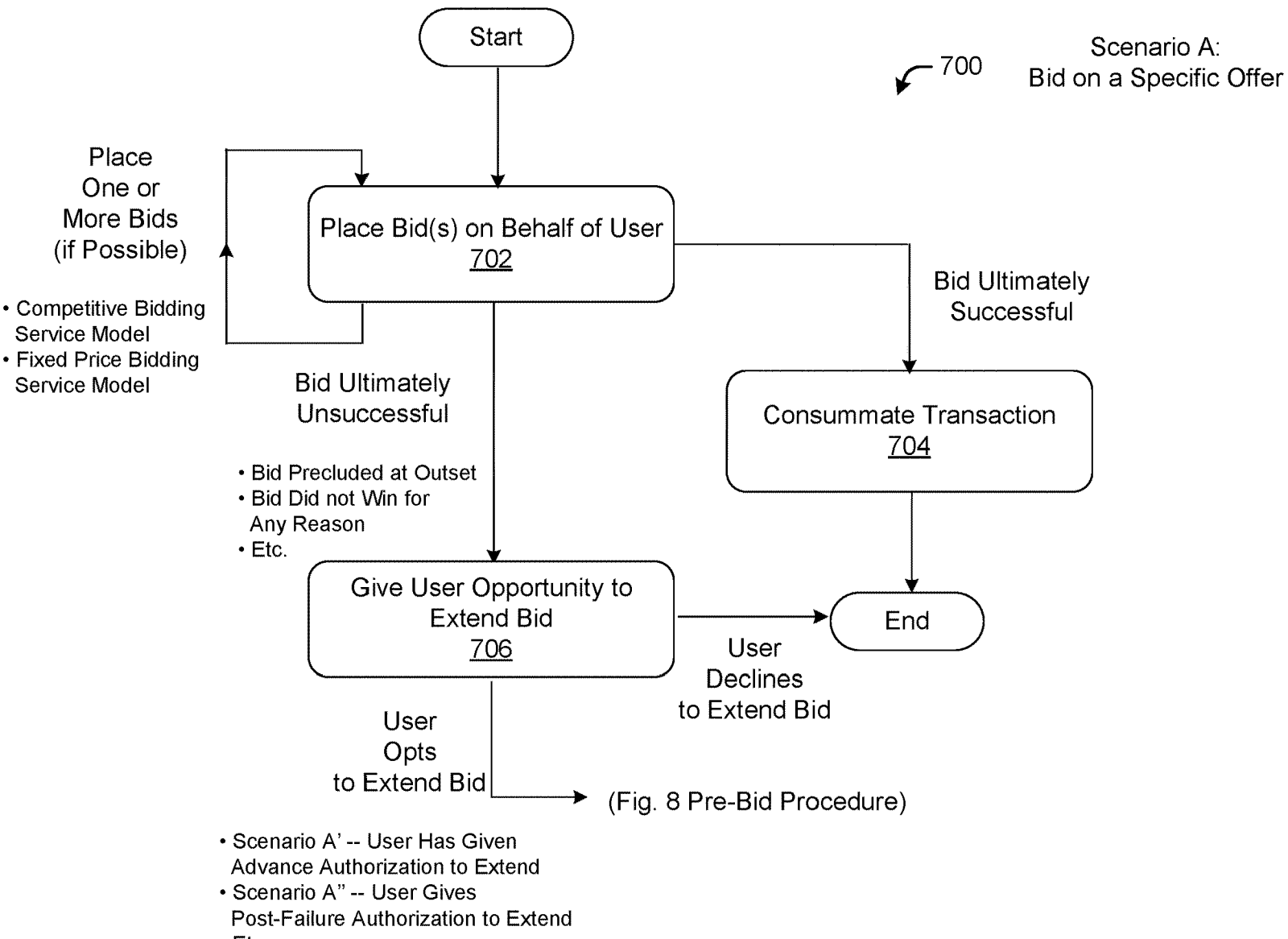
FIG. 7 shows an exemplary bidding procedure for acquiring an item according to a first scenario.
Figure 8:
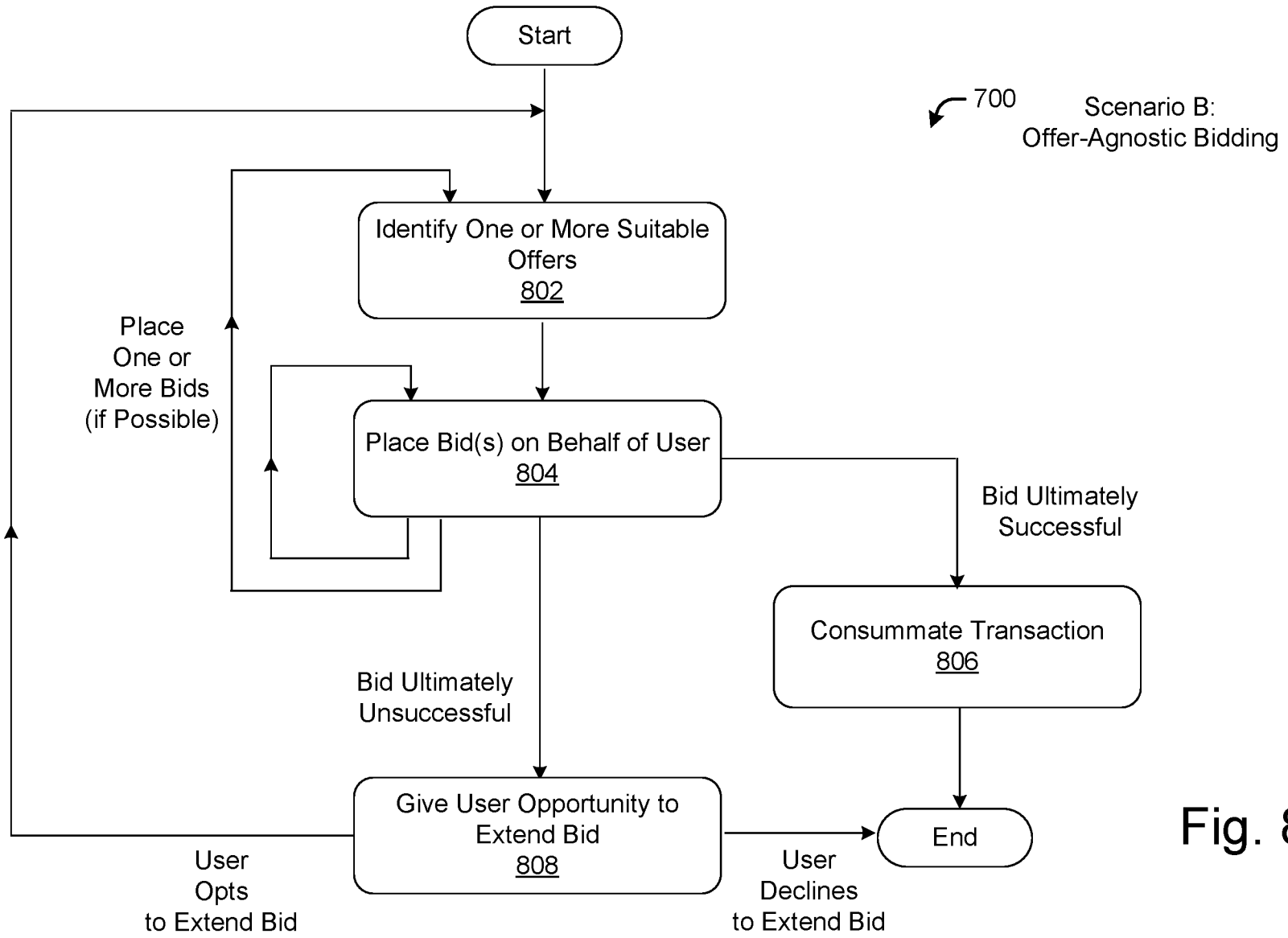
FIG. 8 shows an exemplary bidding procedure for acquiring an item according to a second scenario.

In block 604, the bidding engine 204 commences the bidding process, which is described in greater detail in FIGS. 7 and 8. For example, the bidding engine 204 can commence the bidding process in response to the buyer activating an execution button on a bid-creation user interface presentation. Or the buyer can specify a time at which the bidding processing should start, and the bidding engine 204 will commence the bidding process at that time.

B.3. An Exemplary Procedure for Conducting Bidding According to a First Scenario: Entering an Offer-Specific Initial Bid The monitoring module 220 (of FIG. 2) attempts to acquire a desired item based on the bidding information entered by the buyer. As discussed above, the monitoring module 220 can operate in different ways depending on a number of factors.

According to one scenario, the buyer may have specified the desired item by selecting a specific offer which features the desired item. FIG. 7 describes different permutations of this basic scenario. According to another scenario, the buyer may have specified the desired item by identifying the item in an offer-independent manner. For instance, in this second scenario, the buyer may find that no offer currently pertains to the desired item; in response, the buyer may prepare the bid without reference to any offer. FIG. 8 describes different permutations of this second basic scenario.

Starting with FIG. 7, the first bidding procedure 700 starts after the buyer enters a bid for a specific offer (or for multiple specific offers). In block 702, the monitoring module 220 attempts to acquire the item through the specified offer. This process can assume different forms depending on the nature of the bidding process involved. For instance, this process can involve acquiring the item at a fixed price (if that is how the offer is structured). Or this process can involve entering one or more bids on the item which competes with other bids by other buyers (if this is how the offer is structured). In the case of a competitive offer, the monitoring module 220 can apply various bidding strategies, such as by bidding on the item at a critical juncture in the bidding process (such as just before the offer's bidding process is about to end).

The activity performed in block 702 is either successful or unsuccessful. This activity is successful when it results in the item being acquired from the specified offer. The activity is unsuccessful when it does not result in the item being acquired from the specified offer.

The activity may fail for one or more reasons. According to a first case, the monitoring module 220 (and/or the bid creation module 206) may, at the outset, determine that the bidding information is deficient in various respects. For instance, assume that the buyer instructs the bidding engine 204 to purchase an item from an identified offer. But that offer may place various constraints on acceptable bids. For example, the seller may not agree to ship the item to the buyer's location. This type of failure may be detected during the initial setup of the bidding information or at the outset of the bidding process or at some other later juncture in the bidding process. According to a second case, the monitoring module 220 may determine that the bid is not successful because the buyer has been outbid by another buyer, or because some other cost-related obstacle has prevented the buyer from acquiring the item. Still other circumstances may explain the failure of the bid. For instance, the seller may have simply withdrawn the offer, and so on.

In block 704, if the bid is successful, the bid consummation module 222 consummates the transaction. This activity can involve sending an email to the buyer that notifies the buyer that the desired item has been acquired.

In block 706, if the bid is not successful, the bid consummation module 222, in conjunction with the bid creation module 206, can give the buyer the option to further extend the bidding process. This provision generally allows the buyer to continue the bidding process based on one or more relaxed offer-matching constraints.

For instance, according to one manner of extending the offer, the bidding engine 204 can allow the buyer to make a bid on another offer which pertains to the same item (or a similar item). In one implementation of this provision, the bidding engine 204 can automatically suggest another offer to the buyer that pertains to the same item. In this case, the buyer can provide a targeted authorization that allows the bidding engine 204 to place a bid for that other offer. In another implementation, the bidding engine 204 can generally receive the buyer's authorization to extend the bidding process to acquire the desired item from any offer that pertains to this item (providing that the offer meets the buyer's bidding criteria). This type of general authorization may extend to any offer that currently exists as well as any offer that has yet to be created by a seller. Because an acceptable offer may not yet exist, this aspect of the bidding procedure can constitute a "pre-bidding" process. As described at length in the previous section, offers which feature the same item are identified by the fact that they share the same master reference information, as assigned by the item authority 124 upon creation of the offers.

The buyer can provide authorization to extend the bidding process in different ways. In a first implementation, the buyer can give the bidding engine 204 advance authorization to extend the bidding process to other offers. That is, the buyer can instruct the bidding engine 204 to attempt to acquire the item from a first-identified offer; in addition, at this time, the buyer can authorize the bidding engine 204 to try to acquire the item from other offers if the first-identified offer fails to furnish the item. In this implementation, the bidding engine 204 does not need to interact with the buyer in order to extend the bidding process. In a second implementation, the buyer does not give the bidding engine 204 advance authorization to extend the bidding process to other offers (that is, upon failure to acquire the item from the first-identified offer). In this implementation, the bidding engine 204 can interact with the buyer in order to extend the bidding process to other potential matching offers. For instance, the bidding engine 204 can provide a prompt to the buyer which allows the buyer to expressly authorize the bidding engine 204 to extend the search. FIG. 9, to be discussed below in turn, shows one exemplary user interface protocol for prompting the buyer in this manner.

The bidding engine 204 can advance to a procedure 800 shown in FIG. 8 when the buyer chooses to extend the search. The bidding procedure 800 corresponds to an offer-agnostic bidding procedure in which the bidding is not necessarily constrained to a specific offer selected by the buyer. (However, if the buyer has indeed chosen to extend the offer by selecting a specific alternative offer, then the bidding process remains offer-specific in nature; in this case, the biding engine 204 can return to block 702 of FIG. 7, in which case all of the above-described operations can be repeated.)

B.4. An Exemplary Procedure for Conducting Bidding According to a Second Scenario: Entering an Offer-Independent Initial Bid As indicated above, the procedure 800 of FIG. 8 corresponds to the case in which offer-agnostic bidding is performed, meaning bidding that is not necessarily tied to a specified offer identified by the buyer, but is only generally constrained based on criteria specified by the buyer.

There are two entry points into the procedure 800. According to the scenario described above, one way of entering the procedure 800 is in response to a failed offer-specific bid (as determined by the procedure of FIG. 7). In this procedure, the bidding engine 204 can use the bidding information that the buyer entered in an offer-specific context to govern the offer-agnostic procedure 800 of FIG. 8. In other words, the offer-specific bidding information can be used to pre-populate the offer-agnostic bidding information without requiring the buyer to reenter this bidding information. This procedure therefore constitutes a fully automatic mechanism for extending the search to other offers. In other implementations, the bidding process may optionally collect one or more pieces of additional information prior to advancing to an offer-agnostic search.

According to another technique, the buyer may initiate the bidding process without ever identifying a specific offer. In this case, the buyer may only generally identify the kind of product that she is interested in acquiring, coupled with various criteria which may constrain this acquisition. The buyer may wish to acquire the item in this manner for different reasons. In one case, the buyer may not wish to go through the effort of identifying a specific offer that pertains to the desired item, although many such candidate offers may currently exist. In another case, the buyer may have made the conclusive determination that no offer currently exists which pertains to the desired item. In this case, the buyer may generally instruct the bidding engine 204 to acquire the item from any acceptable offer that may become available in the future. This defines a pre-bidding protocol. Still other circumstances may allow the buyer to initiate the offer-agnostic bidding process of FIG. 8.

The core of the bidding process includes two bidding operations identified in blocks 802 and 804. In block 802, the monitoring module 220 can attempt to determine whether one or more offers match the bidding information associated with the item that the buyer wishes to acquire. A match can be determined by comparing the bidding information with the available offer information. The master reference information provided by the item authority 124 serves a useful role in this regard by establishing a pool of offers that pertain to the same item. That is, the monitoring module 220 can identify a group of offers that feature the same item by identifying offers which share the same master reference information (e.g., which may correspond to a unique code).

In block 804, after the buyer has identified an acceptable offer, the monitoring module 220 places a bid on this offer.

Again, this operation can take different forms depending on the biding paradigm that is being invoked. In a fixed price bidding paradigm, the monitoring module 220 can immediately acquire the item provided that the conditions of sale match the buyer's bidding information. In a competitive bidding paradigm, the monitoring module 220 can enter one or more competitive bids.

The offer-agnostic bidding represented by blocks 802 and 804 may or may not be successful. If a bid is successful, block 806 involves automatically acquiring the item and sending the buyer an appropriate notification.

The bid may alternatively be unsuccessful for various reasons, including any of the reasons enumerated above with respect to FIG. 7. In one case, the monitoring module 220 may be unsuccessful in finding an offer that meets all of the bidding criteria specified by the buyer. Or the monitoring module 220 may find one or more offers, but it may be unsuccessful in bidding on the offers (e.g., because the monitoring module 220 is outbid by another buyer). If the offer-agnostic bidding is unsuccessful, block 808 can give the buyer the option of extending the bidding process. This may involve allowing the buyer to extend the time period for which the monitoring module 220 conducts the bidding process, and/or relaxing one or more criteria that govern the bidding process. For instance, the buyer might specify that the bidding process is to be conducted with a lower seller rating than previously specified (e.g., a 3-star rating instead of a 4-star rating). Or the buyer might specify that the bidding process is to be repeated with a lower item-condition rating than previously specified (e.g., a fair condition instead of an excellent condition). Or the buyer might decide to increase the maximum amount of money that the buyer is willing to spend for the item. Or the buyer might decide to expand the bidding process to items that are related (but perhaps not identical) to the desired item. For instance, if the buyer is interested in acquiring a book of a particular title, the buyer might specify that he or she is now willing accept the book regardless of its version (rather than demanding that the monitoring module 220 acquire the most current version). The buyer may relax the bidding process in yet further ways.

C. Exemplary User Interface Presentations (FIGS. 9 and 10)

FIGS. 9 and 10 show exemplary user interface presentations that can be provided by the bidding engine 204. The user interface presentations enable the buyer to interact with the bidding engine 204. More specifically, FIG. 9 shows a series of user interface presentations in which the buyer initiates the bidding process by instructing the bidding engine 204 to acquire the item from a specific offer. FIG. 10 shows a series of user interface presentations in which the buyer initiates the bidding process by instructing the bidding engine 204 to acquire the item without identifying a specific offer.

C.1. An Exemplary Series of User Interface Presentations for Conducting Bidding According to the First Scenario: Entering an Offer-Specific Initial Bid Considering FIG. 9 first, this figure shows a series of user interface presentations for conducting offer-specific bidding. Namely, a first user interface presentation 902 allows the buyer to identify a specific offer that pertains to a desired item. A second user interface presentation 904 allows the buyer to identify the criteria that will govern the bidding process. The remaining user interface presentations (906, 908) show information that is conveyed by the bid consummation module 222 in response to the success or failure of the bid, respectively. The buyer may invoke the success/failure user interface presentations (906, 908) upon activating a hypertext link in an email 910 that has been sent to the buyer by the bid consummation module 222.

Starting with the first user interface presentation 902, this page is one exemplary and non-limiting way that the buyer can select a specific offer. In this case, the buyer has accessed a product detail page that corresponds to the desired item—in this case a hypothetical "Nikon XYZ" camera. The buyer may access this user interface presentation 902 in a conventional fashion; for instance, the buyer may access this presentation by entering a key term into a search engine, by traversing a hierarchical catalog tree, and so on. The exemplary user interface presentation 902 shows a first field 912 that provides offer-independent information regarding the product. The user interface presentation 902 can also include a second field 914 that provides information regarding one or more offers by sellers that feature the Nikon XYZ camera. The buyer may initiate a bid on a specific offer in various ways, such as by activating a "Bid on This Offer" command.

In another scenario, the user interface presentation 902 can allow the user to select multiple offers for the same item. The monitoring module 220 can then place simultaneous bids (or alternatively, consecutive bids in a defined order) on these multiple offers. The monitoring module 220 can acquire the item through one of the bids based on various rules. In one case, for instance, the monitoring module 220 can acquire the item from the first bid that proves successful.

In an alternative implementation, each seller may create a unique page that describes the item that the seller is offering. Different sellers may describe the same item in different ways (but even in this case, the item authority 124 still links all of the offers that pertain to the same item). In this scenario, the bidding engine 204 can allow the buyer to search through multiple offer pages to find a suitable offer.

In response to the buyer's selection of a specific offer, the bid creation module 206 presents the user interface presentation 904. This user interface presentation 904 solicits bidding information from the buyer. Exemplary bidding information includes a maximum amount of money that the buyer has agreed to spend to acquire the item, an indication of the time period for which the bidding engine 204 is authorized to bid on the selected offer, and on. The user interface presentation 904 can also allow the buyer to enter shipping information (defining where the item is to be shipped and how it is to be shipped) and payment information (defining how the item is to be paid for). If the buyer has entered this information on a prior occasion, the bid creation module 206 can pre-populate this information on behalf of the buyer.

The bid success user interface presentation 906 informs the buyer that her bid was successful and optionally provides other salient information regarding the transaction that has taken place. (Alternatively, for a fixed price bid, the bidding engine 204 may optionally give the buyer the option of providing a final confirmation that the acquisition should take place).

The bid failure user interface presentation 908 informs the buyer that her bid was not successful for any number of reasons identified in the context of FIG. 7. The bid failure presentation 908 also gives the buyer the option of extending the bidding process to other offers that may also feature the item. In other words, the bid failure page 908 may invite the buyer to enter the offer-agnostic bidding procedure 800 described above with reference to FIG. 8. If the buyer opts to extend the bidding process, the bidding engine may advance the buyer to another bid information collection page that is appropriate to the new bidding paradigm (namely, the offer-agnostic bidding paradigm).

In an alternative scenario, the buyer may have given the bidding engine 204 pre-authorization to extend the bidding process to other offers, that is, in the event that the first-identified offer is not successful in providing the desired item. For instance, the buyer may select such pre-authorization via a pre-authorization field 916 in the user interface presentation 904. In this scenario, the bidding engine 204 does not need to interact with the buyer to continue to the bidding process with respect to other offers.

C.2. An Exemplary Series of User Interface Presentations for Conducting Bidding According to the Second Scenario: Entering an Offer-Independent Initial Bid FIG. 10 shows a series of user interface presentations that allow a buyer to initiate a bidding process without first identifying a specific offer. Namely, a first user interface presentation 1002 allows the buyer to generally specify a desired item, but without instructing the bidding engine to first look to a specific offer to furnish the item. A second user interface presentation 1004 collects bidding information from the buyer pertaining to the desired item. The remaining user interface presentations (1006, 1008) inform the buyer of the success and failure of the buyer's offer-agnostic bid, respectively. The buyer may invoke these user interface presentations (1006, 1008) after receiving an email 1010 from the bid consummation module 222.

Starting with the user interface presentation 1002, this presentation shows one non-limiting way that the buyer may initiate an offer-agnostic bidding procedure. In this scenario, the buyer has activated a product detail page (in response to performing a keyword search, catalogue search, and so on). The user interface presentation 1002 can include a first field 1012 which provides general information regarding the desired item. But, in contrast to the user interface presentation 902 of FIG. 9, the user interface presentation 1002 does not reveal any offers for this item (potentially because there are currently no offers for this item). A field 1014 allows the buyer to nevertheless initiate the bidding procedure for any suitable offer that pertains to the desired item, including an offer that may become available in the future.

The buyer can initiate offer-agnostic bids in other ways. For example, the buyer can identify an offer that is related to a desired item, but which falls short in one or more respects. For instance, the buyer may be interested in purchasing a book in soft-cover format, but can only find an offer for the same book in hard-cover format. The buyer might select the offer-agnostic search by accessing the hard-cover offer, and then using that offer as a vehicle to enter bidding criteria. Namely, the buyer can use the hard-cover offer to automatically populate the bidding information for this item, and then supplement the bidding information by specifying that a soft-cover book is desired rather than a hard-cover book. Still other strategies can be used to specify offer-agnostic bids.

When the buyer activates a "Place Bid Now" command (or like command), the bidding engine 204 can provide the second user interface presentation 1004. This user interface presentation 1004 collects additional bidding information from the buyer, including price information, time interval information, item condition information, seller rating information, and so forth. The user interface presentation 1004 can also collect shipping information and payment information in the manner described above.

Incidentally, the bidding engine 204 can also present a user interface presentation to the buyer that is similar to the user interface presentation 1004 when the buyer initiates an offer-agnostic search after the failure of an offer-specific search. In other words, the bidding engine 204 can advance to the user interface presentation 1004 in response to the buyer's instruction to extend the bidding process in the context of the user interface presentation 908 (of FIG. 9).

The user interface presentation 1006 informs the buyer that the offer-agnostic bidding process has been successful, and may provide other salient information regarding the successful transaction. The bid failure user interface presentation 1008 informs the buyer that the offer-agnostic search has been unsuccessful. This presentation 1008 can also allow the buyer to extend the search in various ways, such as by extending the time period for the bidding process, relaxing one or more criteria that will govern the bidding process, and so forth.

In closing, although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

What is claimed is:

1. A system comprising:

one or more processors; and one or more non-transitory computer-readable media storing computer-executable instructions that, when executed by the one or more processors, cause the one or more processors to perform operations comprising:

receiving, via a bidder user interface on a customer device, bidding information corresponding to a bid to acquire an item;

determining whether the bidding information provides a first instruction to acquire the item from one or more specified offers of a plurality of offers or whether the bidding information provides a second instruction to acquire the item from any offer of the plurality of offers, wherein the plurality of offers feature the item;

upon determining that the bidding information provides the first instruction to acquire the item from the one or more specified offers of the plurality of offers:

identifying the one or more specified offers;

placing a first bid on a first offer of the one or more specified offers; and based at least in part on a first determination that the first bid on the first offer is unsuccessful, automatically placing a second bid on a second offer of the one or more specified offers; and upon determining that the bidding information provides the second instruction to acquire the item from any offer of the plurality of offers:

identifying, based at least in part on the bidding information and offer information associated with the plurality of offers, a third offer of the plurality of offers;

placing a third bid on the third offer; and based at least in part on a second determination that the third bid on the third offer is unsuccessful:

automatically identifying, based at least in part on the bidding information and the offer information, a fourth offer for a same or a related item without receiving additional information via the bidder user interface, wherein the same or the related item is associated with a same or a related code to a code associated with the item; and automatically placing a fourth bid on the fourth offer for the same or the related item.

2. The system as claim 1 recites, the operations further comprising:

based at least in part on a third determination that the second bid on the second offer is unsuccessful, causing a presentation on the customer device of an option to acquire the item from any offer of the plurality of offers.

3. The system as claim 1 recites, the operations further comprising:

receiving, from the customer device, data identifying the one or more specified offers; and storing the data identifying the one or more specified offers in a datastore, the one or more specified offers being associated with a customer.

4. The system as claim 1 recites, the operations further comprising:

determining an end time associated with a closure of the first offer; and determining that a current time is within a threshold time of the end time, wherein placing the first bid on the first offer is based at least in part on a third determination that the current time is within the threshold time of the end time.

5. The system as claim 1 recites, the operations further comprising:

determining that the second bid on the second offer of the one or more specified offers is unsuccessful; and sending a notification that the second bid on the second offer was unsuccessful to the customer device.

6. The system as claim 1 recites, wherein the first bid comprises a bid for a first amount of money, and the second bid comprises a bid for a second amount of money, the second amount of money being greater than the first amount of money.

7. One or more non-transitory computer-readable media storing computer-executable instructions that, when executed by one or more processors, cause the one or more processors to perform operations comprising:

receiving, from a customer device, bidding information corresponding to a bid to acquire an item;

determining whether the bidding information provides a first instruction to acquire the item from one or more specified offers of a plurality of offers or whether the bidding information provides a second instruction to acquire the item from any offer of the plurality of offers, wherein the plurality of offers feature the item;

upon determining that the bidding information provides the first instruction to acquire the item from the one or more specified offers of the plurality of offers:

identifying the one or more specified offers; and placing a first bid on a first offer of the one or more specified offers; and upon determining that the bidding information provides the second instruction to acquire the item from any offer of the plurality of offers:

identifying, based at least in part on the bidding information and offer information associated with the plurality of offers, a second offer of the plurality of offers;

placing a second bid on the second offer; and based at least in part on a determination that the second bid on the second offer is unsuccessful:

automatically identifying based at least in part on the bidding information and the offer information associated with the plurality of offers, a third offer for a same or a related item without receiving additional information via a bidder user interface accessible to the customer device, wherein the same or the related item is associated with a same or a related code to a code associated with the item; and automatically placing a third bid on the third offer for the same or the related item.

8. The one or more non-transitory computer-readable media as claim 7 recites, wherein the determination that the second bid is unsuccessful comprises a first determination, the operations further comprising:

determining an end time associated with a closure of the first offer; and determining that a current time is within a threshold time of the end time, wherein the placing the first bid on the first offer is based at least in part on a second determination that the current time is within the threshold time of the end time.

9. The one or more non-transitory computer-readable media as claim 7 recites, wherein the determination that the second bid is unsuccessful comprises a first determination, the operations further comprising:

based at least in part on a second determination that the first bid on the first offer is unsuccessful, automatically placing another bid on the first offer, wherein the other bid on the first offer comprises:

a bid for a pre-determined amount of money; or a pre-determined increase to an amount of money associated with the first bid on the first offer.

10. The one or more non-transitory computer-readable media as claim 7 recites, the operations further comprising:

receiving an indication of a maximum amount of money available for bidding on the first offer;

determining that the first bid on the first offer is unsuccessful; and iteratively bidding on the first offer until the maximum amount of money is reached or the first offer is no longer available.

11. The one or more non-transitory computer-readable media as claim 7 recites, the operations further comprising:

determining that the first bid on the first offer is unsuccessful;

generating a notification that the first bid was unsuccessful; and sending the notification to the customer device for display via the bidder user interface accessible to the customer device.

12. The one or more non-transitory computer-readable media as claim 7 recites, the operations further comprising:

receiving, from the customer device, data identifying the first offer that features the item; and storing the data identifying the first offer in a datastore, the first offer being associated with a customer.

13. The one or more non-transitory computer-readable media as claim 7 recites, the operations further comprising:

determining that the first bid is unsuccessful; and causing a presentation, on the customer device, of an option to acquire the item from any offer of the plurality of offers.

14. A server computing device comprising:

one or more processors; and one or more non-transitory computer-readable media storing computer-executable instructions that, when executed by the one or more processors, cause the one or more processors to perform operations comprising:

receiving, from a customer device, bidding information corresponding to a bid to acquire an item;

determining whether the bidding information provides a first instruction to acquire the item from one or more specified offers of a plurality of offers or whether the bidding information provides a second instruction to acquire the item from any offer of the plurality of offers, wherein the plurality of offers feature the item;

upon determining that the bidding information provides the first instruction to acquire the item from the one or more specified offers of the plurality of offers:

identifying a first offer of the one or more specified offers that features the item; and placing a first bid on the first offer; and upon determining that the bidding information provides the second instruction to acquire the item from any offer of the plurality of offers:

identifying, based at least in part on the bidding information and offer information associated with the plurality of offers, a second offer, of the plurality of offers, that features the item;

placing a second bid on the second offer; and based at least in part on a determination that the second bid is unsuccessful:

automatically identifying, based at least in part on the bidding information and the offer information associated with the plurality of offers, a third offer, of the plurality of offers, for a same or a related item, without receiving additional information via a bidder user interface accessible to the customer device, wherein the same or the related item is associated with a same or a related code to a code associated with the item; and automatically bidding on the third offer for the same or the related item.

15. The server computing device as claim 14 recites, wherein the determination comprises a first determination, the operations further comprising:

based at least in part on a second determination that the first bid on the first offer is unsuccessful, automatically placing another bid on the first offer.

16. The server computing device as claim 14 recites, wherein the determination comprises a first determination, the operations further comprising:

determining an end time associated with a closure of the first offer; and determining that a current time is within a threshold time of the end time, wherein the placing the first bid on the first offer is based at least in part on a second determination that the current time is within the threshold time of the end time.

17. The server computing device as claim 14 recites, the operations further comprising:

receiving an indication of a maximum amount of money available for bidding on the first offer;

determining that the first bid on the first offer is unsuccessful; and iteratively bidding on the first offer until the maximum amount of money is reached or the first offer is no longer available.

18. The server computing device as claim 14 recites, the operations further comprising:

determining that the first bid is unsuccessful; and sending a notification to the customer device that the first bid was unsuccessful.

19. The server computing device as claim 14 recites, the operations further comprising:

determining that the first bid is unsuccessful; and causing a presentation, on the customer device, of an option to acquire the item from any offer of the plurality of offers.

20. The server computing device as claim 14 recites, the operations further comprising:

receiving, from the customer device, data identifying the first offer; and storing the data identifying the first offer in a datastore, the first offer being associated with a customer.

* * * * *